US010649394B2

(12) United States Patent
Makiguchi et al.

(10) Patent No.: US 10,649,394 B2
(45) Date of Patent: May 12, 2020

(54) METHOD OF MANUFACTURING FRAME UNIT, METHOD OF MANUFACTURING IMAGE CARRYING UNIT, METHOD OF MANUFACTURING CARTRIDGE, AND CARTRIDGE

(71) Applicant: CANON KABUSHIKI KAISHA, Tokyo (JP)

(72) Inventors: Daisuke Makiguchi, Izunokuni (JP); Tadashi Horikawa, Numazu (JP); Naoki Matsumaru, Suntou-gun (JP); Ryuta Murakami, Suntou-gun (JP); Tetsuya Numata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/366,924

(22) Filed: Mar. 27, 2019

(65) Prior Publication Data

US 2019/0302678 A1 Oct. 3, 2019

(30) Foreign Application Priority Data

Mar. 30, 2018 (JP) ..... 2018-068252
Feb. 12, 2019 (JP) ..... 2019-022803

(51) Int. Cl.
*G03G 15/00* (2006.01)
*G03G 21/16* (2006.01)
*G03G 21/18* (2006.01)

(52) U.S. Cl.
CPC ..... *G03G 21/1647* (2013.01); *G03G 21/1619* (2013.01); *G03G 21/181* (2013.01); *G03G 21/1821* (2013.01); *G03G 21/1825* (2013.01); *G03G 2215/00987* (2013.01); *G03G 2221/1651* (2013.01); *G03G 2221/1869* (2013.01)

(58) Field of Classification Search
CPC ..... G03G 21/1619; G03G 21/181; G03G 21/1821
USPC ..... 399/107, 109, 111
See application file for complete search history.

(56) References Cited

U.S. PATENT DOCUMENTS 8,238,784 B2 * 8/2012 Kusudo et al. .... G03G 21/1821 399/109
8,942,593 B2 * 1/2015 Thompson ..... G03G 21/181 399/111
2011/0268471 A1 11/2011 Miyazaki et al.

FOREIGN PATENT DOCUMENTS

JP 2009109848 A 5/2009
JP 2017223952 A 12/2017

* cited by examiner

*Primary Examiner* — William J Royer
(74) *Attorney, Agent, or Firm* — Canon U.S.A., Inc. IP Division

(57) ABSTRACT

A method of manufacturing a frame unit from a first unit. The first unit includes a first image carrying member, a supporting member supporting the first image carrying member, and a frame to which the supporting member is adhered. The first image carrying member includes a first edge portion member, and the first edge portion member includes a first restricted portion. The supporting member includes a bearing engaging with the first edge portion member so that the first image carrying member is rotatable about a rotational axis. The frame includes a first restricting portion restricting movement of the first image carrying member. The method includes separating in which the first image carrying member is separated from the supporting member while in a state in which the supporting member is adhered to the frame.

26 Claims, 19 Drawing Sheets

METHOD OF MANUFACTURING FRAME UNIT, METHOD OF MANUFACTURING IMAGE CARRYING UNIT, METHOD OF MANUFACTURING CARTRIDGE, AND CARTRIDGE

BACKGROUND OF THE INVENTION

Field of the Invention

The present disclosure relates to a method of manufacturing a frame unit used in an electrophotographic image forming apparatus, a method of manufacturing an image carrying unit, a method of manufacturing a cartridge, and a cartridge.

An electrophotographic image forming apparatus is an apparatus that forms an image on a recording medium using an electrophotographic image forming system. Examples of the electrophotographic image forming apparatus include, for example, an electrophotographic copying machine, an electrophotographic printer (an LED printer, a laser printer, and the like), a facsimile machine, and a word processor.

A cartridge is a member including a photosensitive member and a process member that acts on the photosensitive member, and is a member mounted in an apparatus main body of the electrophotographic image forming apparatus in a detachable manner.

Description of the Related Art

A photosensitive member (a photosensitive drum) serving as an image carrying member that carries an electrostatic latent image is used in an electrophotographic image forming apparatus (hereinafter, referred to as an "image forming apparatus").

The photosensitive member is charged, and an electrostatic latent image (an electrostatic image) is formed on the photosensitive member by selectively exposing the charged photosensitive member. Subsequently, the electrostatic latent image is developed as a toner image with toner serving as developer. Subsequently, the toner image formed on the photosensitive member is transferred on a recording material such as a recording sheet or a plastic sheet and, further, heat and pressure is applied to the toner image transferred on the recording material so as to fix the toner image on the recording material and to perform image recording.

Typically, such an image forming apparatus needs to have toner supplied thereto and maintenance needs to be performed on the various process members thereof. Accordingly, there are image forming apparatuses in which a cartridge including the photosensitive member and a frame that supports the photosensitive member is configured in an attachable manner in the apparatus main body of the image forming apparatus. Such a cartridge system allows the user to perform a portion of the maintenance of the apparatus and allows a user to attach the cartridge to the apparatus main body and/or detach the cartridge from the apparatus main body.

Japanese Patent Laid-Open No. 2017-223952 discloses a cartridge in which a drive-side drum flange attached to a photosensitive drum includes a flange portion, and a cleaning frame which includes a drum restricting rib. The drum restricting rib is, in a longitudinal direction, disposed on a nondrive side with respect to the flange portion of the drive-side drum flange, and opposes the flange portion with a gap in between. When the photosensitive drum moves towards the nondrive side by an amount exceeding the gap, the flange portion and the drum restricting rib come in contact with each other and the movement of the photosensitive drum is restricted.

Toner accommodated in the cartridge is consumed as the image forming operation is repeated. Furthermore, the photosensitive drum becomes worn away. As a result, the cartridge becomes unable to form an image having a quality that can satisfy the user, and the product value of the cartridge is lost.

A method of recycling a cartridge that has lost its product value has been proposed. Japanese Patent Laid-Open No. 2009-109848 discloses a method of replacing a used photosensitive drum with a new photosensitive drum. More specifically, a supporting member attached to a drum frame with a screw is detached from the drum frame. With the above, a support member (a shaft) of the photosensitive drum is released. Subsequently, the photosensitive drum is detached from the drum frame, and a new photosensitive drum is attached to the drum frame.

When recycling a cartridge having a drum restricting rib as described in Japanese Patent Laid-Open No. 2017-223952, there are cases in which the drum restricting rib and the photosensitive drum interfere with each other when detaching or attaching the photosensitive drum.

SUMMARY OF THE INVENTION

The present disclosure provides a method of recycling a first unit that includes an image carrying member including an edge portion member having a restricted portion, a frame to which a supporting member supporting the image carrying member is adhered, and a restricting portion restricting the restricted portion. More specifically, a method of manufacturing a frame unit, which supports the image carrying member, by disassembling the first unit can be provided. Furthermore, the present disclosure provides a frame unit manufactured with the above method, and a cartridge including the frame unit.

An aspect of the disclosure according to the present application is as follows.

A method of manufacturing a frame unit from a first unit, in which the first unit includes, a first image carrying member that is arranged to carry an electrostatic latent image, wherein the first image carrying member includes a first edge portion member, and the first edge portion member includes a first restricted portion, a supporting member that supports the first image carrying member, wherein the supporting member includes a bearing that is arranged to engage with the first edge portion member so that the first image carrying member is rotatable about a rotational axis, and a frame to which the supporting member is adhered, wherein the frame includes a first restricting portion that is arranged to restrict movement of the first image carrying member, wherein in a direction orthogonal to the rotational axis, the first restricting portion protrudes towards the first image carrying member, and the first restricting portion is arranged to abut against the first restricted portion if the first restricted portion is moved towards an inside of the supporting member in a direction of the rotational axis, in which with respect to the direction of the rotational axis, a position of the first restricting portion and a position of the bearing overlap each other at least partially, and in which when viewed in the direction of the rotational axis, the first restricting portion is arranged to overlap a first circle drawn by the first restricted portion if the first image carrying member is rotated about the rotational axis, the method of manufacturing the frame unit from the first unit including a separating step in which the first image carrying member is separated from the supporting member while the supporting member is adhered to the frame.

Another aspect of the disclosure according to the present application is as follows.

A cartridge attachable to an image forming apparatus, the cartridge including an image carrying member that is arranged to carry an electrostatic latent image, wherein the image carrying member includes an edge portion member, and the edge portion member includes a restricted portion, a supporting member that supports the image carrying member, wherein the supporting member includes a bearing that is arranged to engage with the edge portion member so that the image carrying member is rotatable about a rotational axis, a frame to which the supporting member is adhered, wherein the frame includes a restricting portion that is arranged to restrict movement of the image carrying member, wherein in a direction orthogonal to the rotational axis, the restricting portion protrudes towards the image carrying member, and wherein the restricting portion is arranged to abut against the restricted portion if the restricted portion is moved towards an inside of the supporting member in a direction of the rotational axis, and a developing unit arranged to hold a developer carrying member for supply of developer to the image carrying member, in which a recessed portion recessed towards the rotational axis is formed in the restricted portion, and in which when viewed in the direction of the rotational axis, the restricting portion overlaps a first circle drawn by the restricted portion if the image carrying member is rotated about the rotational axis, and a circle drawn by the recessed portion if the image carrying member is rotated about the rotational axis is located inside the first circle.

Further features of the present invention will become apparent from the following description of exemplary embodiments with reference to the attached drawings.

DESCRIPTION OF THE EMBODIMENTS

Hereinafter, examples of embodiments of the present disclosure will be described with reference to the drawings. Note that in principle, the dimensions, the materials, and the shapes of the components, the relative configuration of the components, and the like that are described in the following embodiments are to be appropriately altered based on the configuration of a device to which the present disclosure is applied and on various conditions, and the scope of the present disclosure is not intended to be limited by the following embodiments. Each of the embodiments of the present invention described below can be implemented solely or as a combination of a plurality of the embodiments. Also, features from different embodiments can be combined where necessary or where the combination of elements or features from individual embodiments in a single embodiment is beneficial.

First Embodiment

Hereinafter, an embodiment of the present disclosure will be described in detail with reference to the drawings.

Overall Configuration of Electrophotographic Image Forming Apparatus

Figure 2:
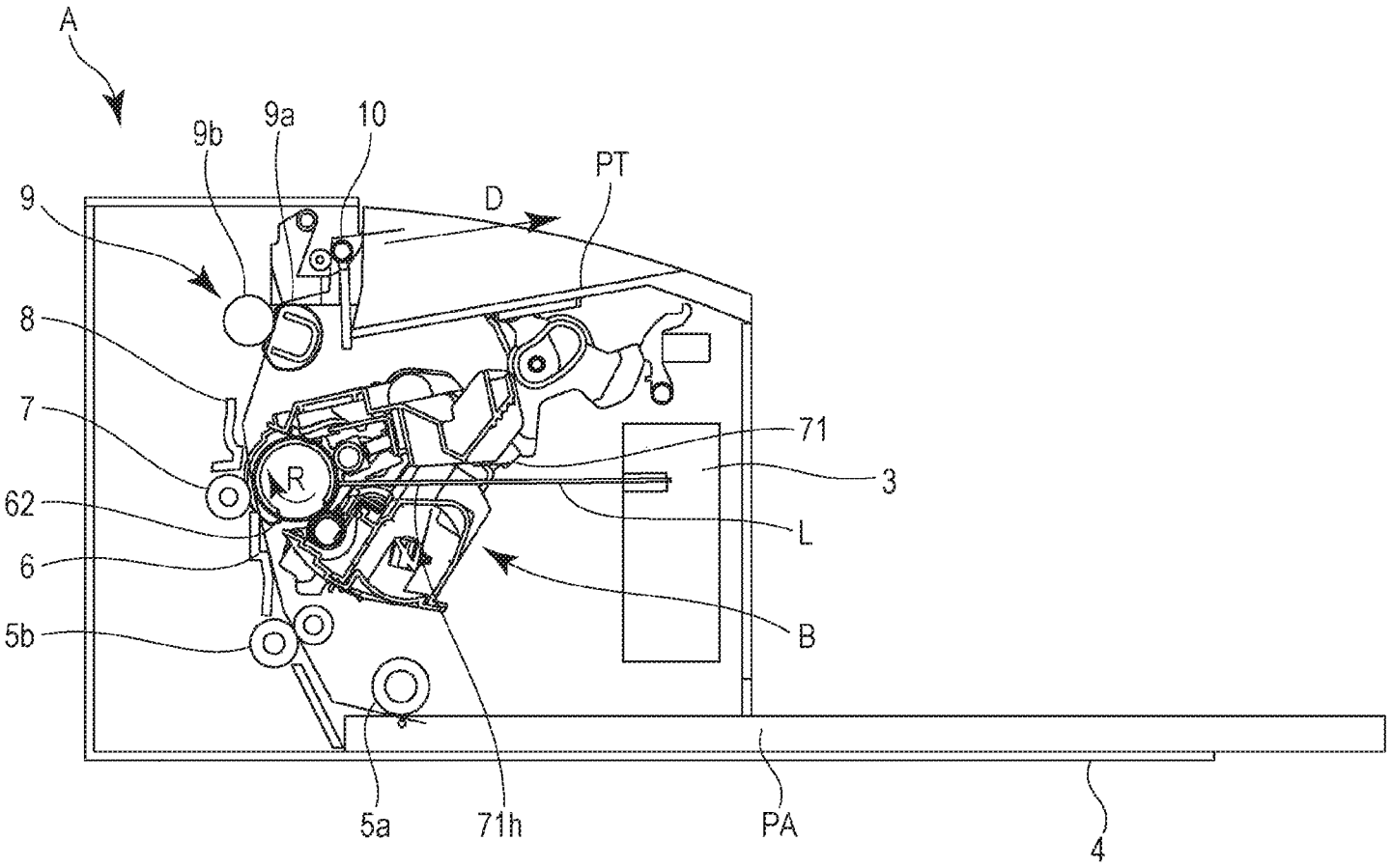
FIG. 2 is a cross-sectional view of an image forming apparatus.
Figure 3:
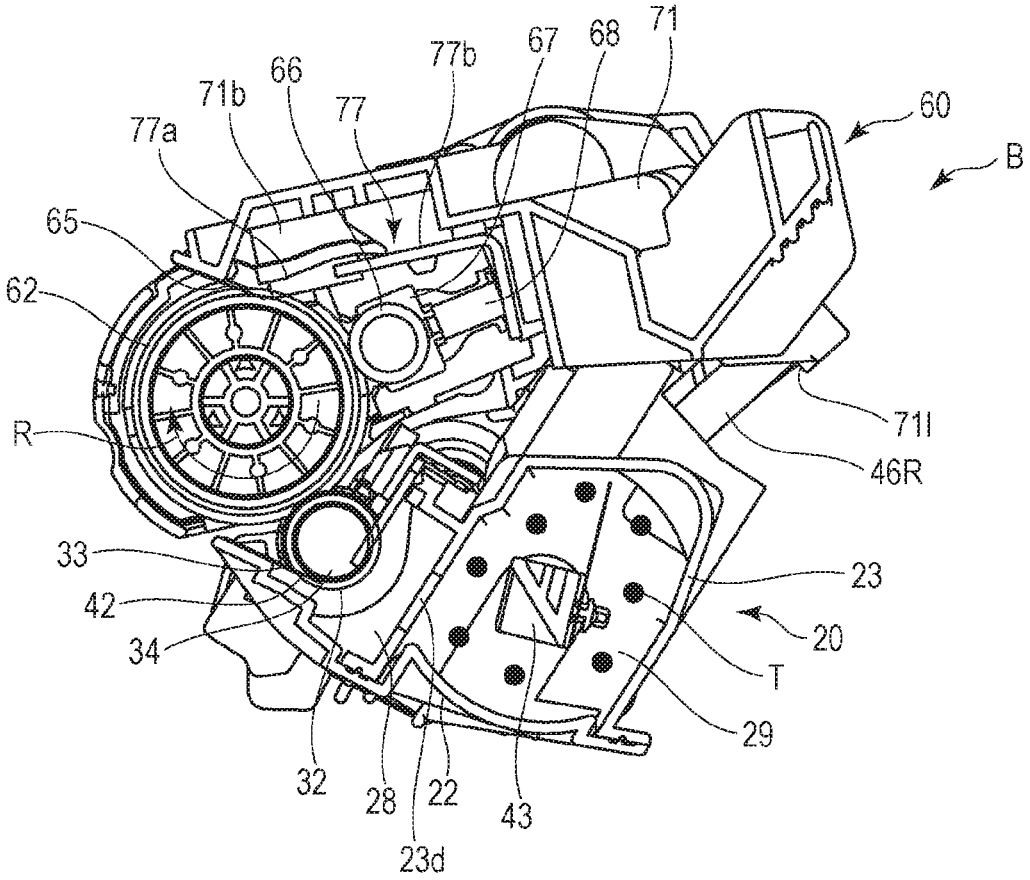
FIG. 3 is a cross-sectional view of a cartridge.

Referring to FIGS. 2 and 3, an overall configuration of an electrophotographic image forming apparatus (hereinafter, an image forming apparatus) and an image forming process will be described.

FIG. 2 is a cross-sectional view of the image forming apparatus. Specifically, FIG. 2 is a cross-sectional view of an apparatus main body (hereinafter, referred to as an apparatus main body A) and a process cartridge (hereinafter, referred to as a cartridge B) of the image forming apparatus according to the present embodiment.

FIG. 3 is a cross-sectional view of the cartridge B according to the present embodiment.

Note that the apparatus main body A is a portion of the image forming apparatus in which the cartridge B has been excluded.

Note that in the following description, a direction of a rotational axis (a rotational axis direction) of an image carrying member described later is referred to as a longitudinal direction. Furthermore, in the longitudinal direction, a side on which an electrophotographic photosensitive drum receives driving force from an image forming apparatus main body is referred to as a drive side, and the opposite side thereof is referred to as a nondrive side.

The image forming apparatus illustrated in FIG. 2 is a laser beam printer using an electrophotographic technique in which the cartridge B is attachable to the apparatus main body A.

An exposure device 3 (a laser scanner unit) that forms an electrostatic latent image on a photosensitive drum 62 described later is disposed in the apparatus main body A. Furthermore, a sheet tray 4 that contains recording mediums (hereinafter referred to as sheet materials PA) that are subjects of image formation is disposed below the cartridge B.

Furthermore, a pickup roller 5*a*, a pair of feed rollers 5*b*, a transfer guide 6, a transfer roller 7, a conveyance guide 8, a fixing device 9, a pair of discharge rollers 10, a discharge tray PT, and the like are sequentially disposed in the apparatus main body A of the apparatus in a conveyance direction D of the sheet material PA. Note that fixing device 9 includes a heat roller 9*a* and a pressure roller 9*b*.

The cartridge B is provided with the photosensitive drum 62 serving as an image carrying member that carries an electrostatic latent image (hereinafter, a latent image). Hereinafter, the photosensitive drum 62 is merely referred to as a drum 62.

Image Forming Process

An outline of the image forming process will be explained next.

Based on a print start signal, the drum 62 is rotationally driven in an arrow R direction in FIG. 2 at a predetermined circumferential velocity (processing speed).

As illustrated in FIG. 3, a charge roller (charge member) 66 to which a voltage is applied contacts an outer peripheral surface of the drum 62 and charges the outer peripheral surface of the drum 62.

As illustrated in FIG. 2, the exposure device 3 outputs a laser beam L according to image information. The laser beam L passing through a laser opening 71*h* provided in a drum supporting frame 71 of the cartridge B performs scanning exposure on the outer peripheral surface of the drum 62. With the above, potential of the outer peripheral surface of the drum 62 decreases. An electrostatic latent image corresponding to the image information is formed on the outer peripheral surface of the drum 62, and the drum 62 conveys the electrostatic latent image.

FIG. 3 illustrates a developing unit 20 serving as a developing device, toner T inside a toner chamber 29 is mixed and conveyed with a rotation of a conveyance member (a mixing member) 43 and is sent out to a toner supply chamber 28.

The toner T is carried on a surface of a development roller 32 with magnetic force of a magnet roller 34 (a stationary magnet). The development roller 32 is a developer carrying member that carries developer (the toner T) on a surface thereof to develop the latent image formed on the drum 62.

While the toner T is triboelectrically charged by a developing blade 42, a layer thickness of the toner T on a peripheral surface of the development roller 32 serving as the developer carrying member is restricted. The developing blade 42 is configured to press the development roller 32. The developing blade 42 is a thickness restricting member that restricts the thickness of a toner layer carried on the development roller 32. Note that in the present embodiment, the toner T is magnetic mono-component developer.

The toner T is supplied to the drum 62 in accordance with the latent image and develops the latent image. With the above, the latent image is visualized as a toner image. The drum 62 is an image carrying member that carries a latent image or an image (a toner image or a developer image) formed with the toner on the surface thereof. Furthermore, as illustrated in FIG. 2, synchronizing with an output timing of the laser beam L, the sheet material PA contained in the bottom portion of the apparatus main body A is sent out from the sheet tray 4 with the pickup roller 5*a* and the pair of feed rollers 5*b*. Subsequently, the sheet material PA is conveyed to a transfer position between the drum 62 and the transfer roller 7 through the transfer guide 6. The toner image is sequentially transferred from the drum 62 to the sheet material PA at the above transfer position.

The sheet material PA to which the toner image has been transferred is separated from the drum 62 and is conveyed along the conveyance guide 8 to the fixing device 9. Subsequently, the sheet material PA passes through a nip portion between the heat roller 9*a* and the pressure roller 9*b* included in the fixing device 9. A compressing and heat fixing process is performed at the nip portion and the toner image is fixed to the sheet material PA. The sheet material PA to which the toner image has been fixed is conveyed to the pair of discharge rollers 10 and is discharged to the discharge tray PT.

After the toner image has been transferred to the sheet material PA, residual toner on the outer peripheral surface of the drum 62 is removed with a cleaning member 77 illustrated in FIG. 3. The drum 62 is used in the image forming process once again. The toner T removed from the drum 62 is stored in a waste toner chamber 71*b* of a photosensitive unit 60.

In the above, the charge roller 66, the development roller 32, the transfer roller 7, and the cleaning member 77 described above are process members that act on the drum 62.

Configuration of a Cartridge

Figure 4:
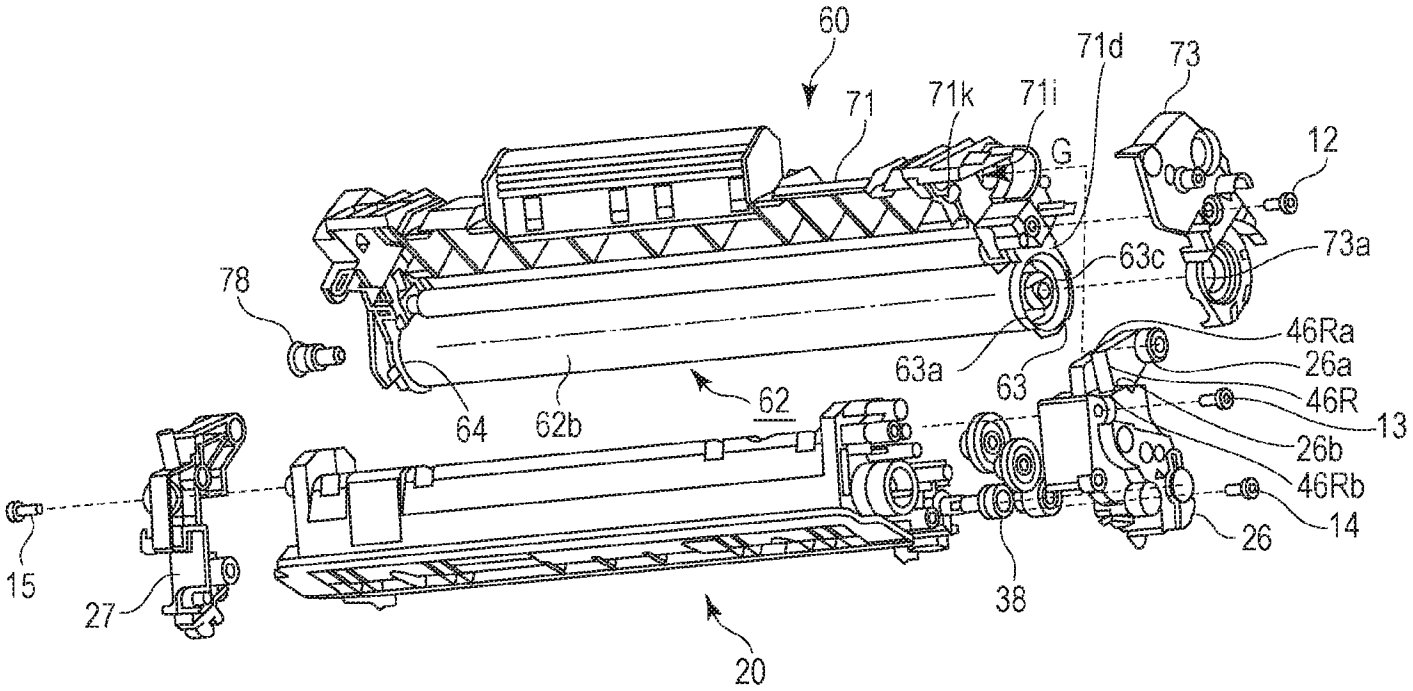
FIG. 4 is a perspective view illustrating a structure of the cartridge.
Figure 5:
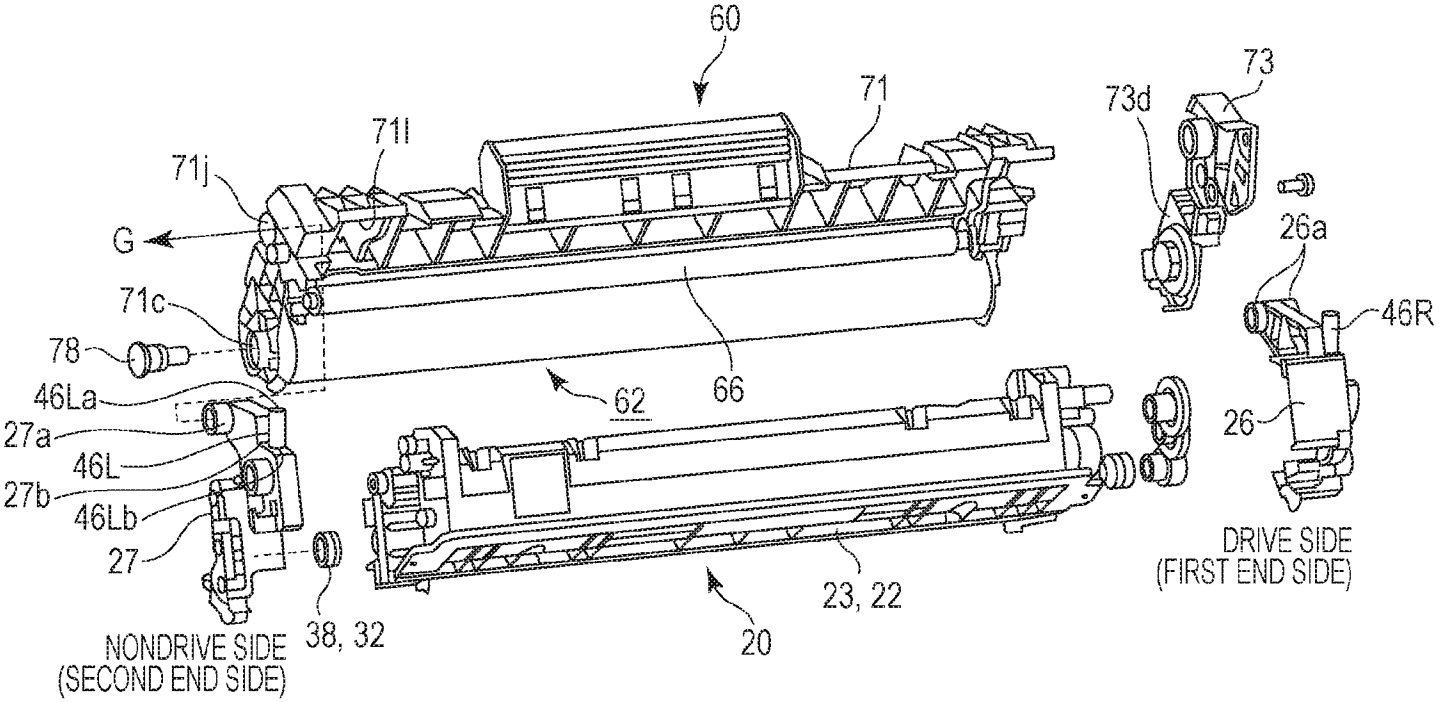
FIG. 5 is a perspective view illustrating a structure of the cartridge.
Figure 7:
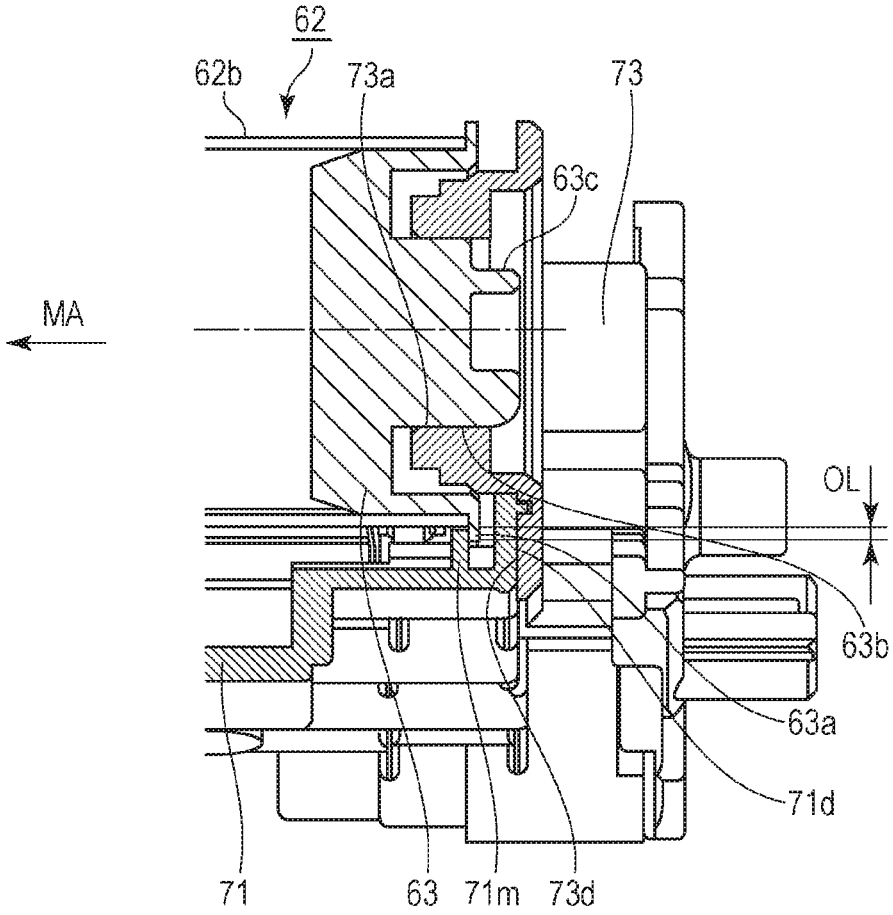
FIG. 7 is a cross-sectional view of the photosensitive unit.
Figure 8:
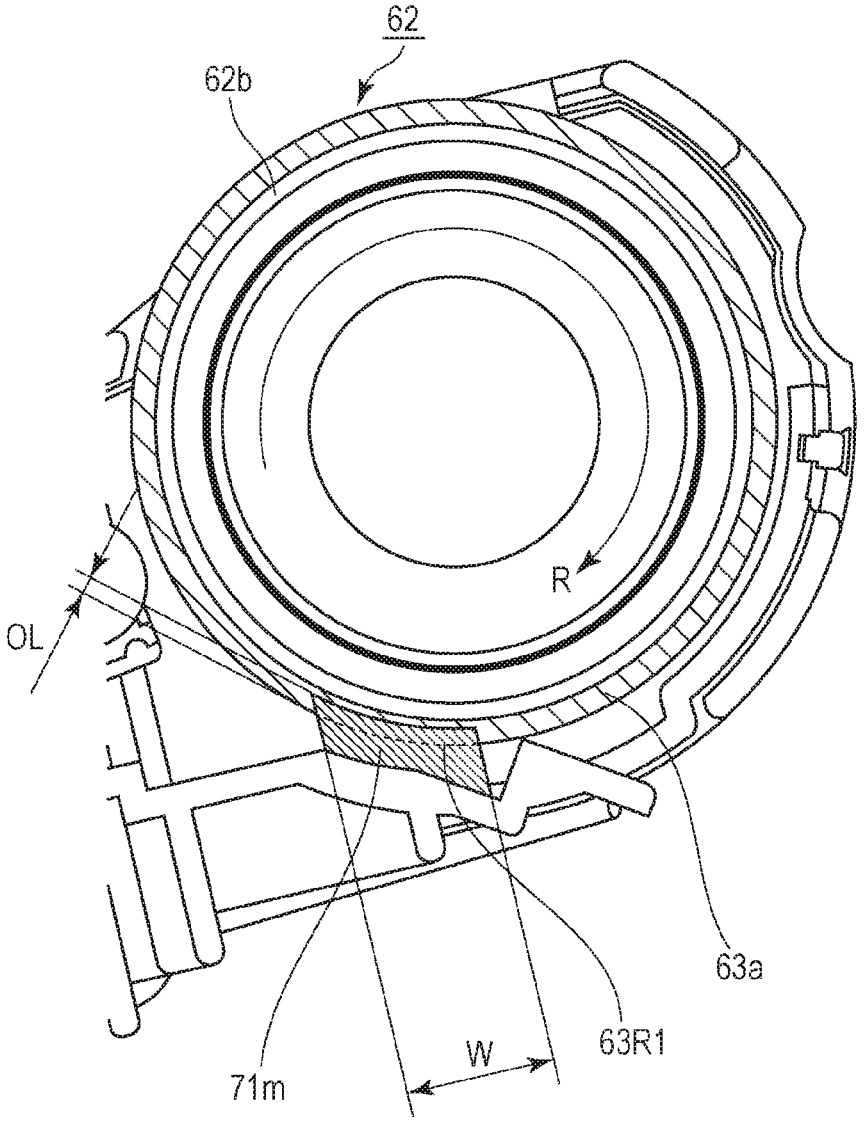
FIG. 8 is a cross-sectional view of the photosensitive unit.

Referring next to FIGS. 3, 4, 5, 7, and 8, an overall configuration of cartridge B will be described. FIGS. 7 and 8 are cross-sectional views of the photosensitive unit 60. More specifically, FIG. 7 is a cross-sectional view of the photosensitive unit 60 cut in a direction of the rotational axis of the drum 62. FIG. 8 is a cross-sectional view of the photosensitive unit 60 cut in a direction orthogonal to the rotational axis of the drum 62. FIGS. 4 and 5 are perspective views illustrating a structure of the cartridge B.

The cartridge B includes the photosensitive unit (corresponding to an image carrying unit, a first unit, or a first material unit) 60 and the developing unit (corresponding to a developer carrying unit) 20.

Note that a member that is an electrophotographic photoconductor and at least one process member that acts on the electrophotographic photoconductor integrated into a cartridge and that is attachable to the apparatus main body of the image forming apparatus is, generally, referred to as a process cartridge. Examples of the process member include a charging device, a developing device, and a cleaning device.

As illustrated in FIG. 3, the photosensitive unit 60 includes the drum 62, the charge roller 66, the cleaning member 77, and the drum supporting frame (a frame) 71 that supports the above.

As illustrated in FIG. 4, the drum 62 includes a cylindrical photosensitive cylinder (a photosensitive member) 62*b*, a drive-side flange (corresponding to an edge portion member or a first edge portion member) 63, and a nondrive-side flange 64. The drive-side flange 63 is, in an axial direction of the photosensitive cylinder 62*b* (same as an axial direction of the drum 62), attached to an end portion of the photosensitive cylinder 62*b* on the drive side. The nondrive-side flange 64 is, in an axial direction of the photosensitive cylinder 62*b*, attached to an end portion of the photosensitive cylinder 62*b* on the nondrive side.

The drum supporting frame 71 includes a first end portion and a second end portion positioned on the side opposite to the first end portion in the longitudinal direction. A drum supporting member (a supporting member) 73 that supports the drum 62 is adhered to the first end portion of the drum supporting frame 71. The drum supporting member 73 is provided with a hole portion 73*a* serving as a bearing that rotatably supports the drive-side flange 63. The drive-side flange 63 is rotatably supported about the rotational axis by the hole portion 73*a* of the drum supporting member 73.

As illustrated in FIG. 7, in a state in which the drum 62 is supported by the hole portion 73*a* of the drum supporting member 73, an axial line of the drum 62 is the same as the rotational axis of the drum 62. In other words, in a state in which the drum 62 is supported by the hole portion 73*a* of the drum supporting member 73, the axial direction of the drum 62 is the same as the direction of the rotational axis of the drum 62.

As illustrated in FIG. 5, a drum shaft 78 is, on the nondrive side, press-fitted into a hole portion 71*c* provided in the drum supporting frame 71. The drum shaft 78 rotatably supports a hole portion (not shown) of the nondrive-side flange 64. The rotational axis of the drum 62 passes through the hole portion 73*a* and the drum shaft 78. In other words, each drum flange is a rotatably supported borne portion.

Note that in the present embodiment, a unit including the drum supporting member 73 and the drum supporting frame 71 is referred to as a frame unit. In other words, the frame unit is a unit capable of supporting the drum 62 and a new drum 162 described later. Furthermore, the photosensitive unit 60 includes the frame unit and the drum 62. Note that in a broad sense, the drum supporting member 73 and the drum supporting frame 71 can be collectively called a drum supporting frame.

As illustrated in FIGS. 4 and 5, the drum supporting member 73 and the drum supporting frame 71 are adhered to each other by an adhesive surface (an adhesive portion) 73*d* of the drum supporting member 73 and an adhesive surface (an adhesive portion) 71*d* of the drum supporting frame 71. Additionally, the drum supporting member 73 and the drum supporting frame 71 are also fixed by a screw 12.

The adhesive surface 73*d* of the drum supporting member 73 and the adhesive surface 71*d* of the drum supporting frame 71 are provided around the hole portion 73*a*. In other words, as illustrated in FIGS. 4, 5, and 7, the hole portion 73*a* is located inside the adhesive surface 73*d* and the adhesive surface 71*d* in a direction orthogonal to the rotational axis of the drum 62. Disassembling and joining of the drum 62 described later, is carried out while the drum supporting frame 71 and the drum supporting member 73 are in an adhered state. Note that in adhering the adhesive surface 73*d* and the adhesive surface 71*d* to each other, an adhesive agent, a terpene solvent, or the like is used; however, it is only sufficient that the adhesive surfaces are adhered to each other and the material of the adhesive agent is not limited to any material.

The charge roller 66 and the cleaning member 77 are disposed in contact with the outer peripheral surface of the drum 62.

The cleaning member 77 includes a rubber blade 77*a* which is a blade-shaped elastic member formed of rubber, and a supporting member 77*b* which supports the rubber blade 77*a*.

The waste toner removed from the surface of the drum 62 with the cleaning member 77 is stored in the waste toner chamber 71*b*.

Furthermore, as illustrated in FIG. 3, in order to prevent the waste toner from leaking through a gap between the drum supporting frame 71 and the drum 62, a sealing sheet 65 is provided at an edge portion of the drum supporting frame 71 so as to abut against the drum 62.

Note that a longitudinal direction of the drum supporting frame 71 (a longitudinal direction of the cartridge B) is the same as the direction of the rotational axis of the drum 62.

The charge roller 66 is supported by a charge roller bearing 67, and the charge roller bearing 67 is pressed towards the drum 62 with a biasing member 68. And the charge roller 66 is energized by the drum 62. The charge roller 66 is rotated by following the rotation of the drum 62.

As illustrated in FIG. 3, the developing unit 20 includes the development roller 32, a developer container 23 that supports the development roller 32, the developing blade 42, and other components. The development roller 32 is rotatably attached to the developer container 23 with bearing members 27 (FIG. 5) and 26 (FIG. 4) provided at both ends. The bearing members 27 and 26 are fixed to the developer container 23 with the screws 13, 14, and 15.

Furthermore, the magnet roller 34 is provided inside the development roller 32. The developing blade 42 that restricts the thickness of the toner layer on the development roller 32 is disposed in the developing unit 20.

As illustrated in FIGS. 4 and 5, spacing members 38 are attached to the development roller 32 at both ends of the development roller 32. By abutting the spacing members 38 and the drum 62 against each other, the development roller 32 is held so as to form a minute gap with the drum 62. The gap is larger than the thickness of the toner layer restricted by the developing blade 42.

Furthermore, as illustrated in FIG. 3, a developing-unit-side sealing sheet 33 that prevents toner from leaking from the developing unit 20 abuts against the development roller 32. Furthermore, the conveyance member 43 that conveys the toner to the toner supply chamber 28 is provided in the toner chamber 29 formed by the developer container 23 and a bottom member 22.

As illustrated in FIGS. 4 and 5, the cartridge B is formed by joining the photosensitive unit 60 and the developing unit 20 to each other.

When joining the developing unit 20 and the photosensitive unit 60 to each other, a position of a first suspension hole 71*i* of the drum supporting frame 71 is aligned with a position of the developing-unit first support boss 26*a* of the developer container 23. At the same time, a position of a second suspension hole 71*j* and a position of a developing-unit second support boss 27*a* are aligned. Furthermore, by moving the developing unit 20 in an arrow G direction, the developing-unit first support boss 26*a* and the developing-unit second support boss 27*a* are fitted to the first suspension hole 71*i* and the second suspension hole 71*j*. With the above, the developing unit 20 is movably connected to the photosensitive unit 60. In more detail, the developing unit 20 is connected to the photosensitive unit 60 in a rotatably (pivotably) movable manner.

After the above, the cartridge B is formed by fixing the drum supporting member 73 to the drum supporting frame 71. The drum supporting member 73 covers an engagement portion of the first suspension hole 71*i* and the developing-unit first support boss 26*a* so as to prevent the developing-unit first support boss 26*a* from falling off from the first suspension hole 71*i*.

Furthermore, a first end portion 46Rb of a drive-side biasing member 46R is fixed to a surface 26*b* of the bearing member 26, and a second end portion 46Ra abuts against a surface 71*k* which is a portion of the drum supporting frame 71.

Furthermore, a first end portion 46Lb of a nondrive-side biasing member 46L is fixed to a surface 27*b* of the bearing member 27, and a second end portion 46La abuts against a surface 71*l* which is a portion of the drum supporting frame 71.

In the present embodiment, the drive-side biasing member 46R (FIG. 4) and the nondrive-side biasing member 46L (FIG. 5) are compression springs. The drive-side biasing member 46R and the nondrive-side biasing member 46L urge the developing unit 20 to the photosensitive unit 60. Furthermore, the development roller 32 is urged towards the drum 62.

A positional relationship between the drum supporting frame 71, the drum supporting member 73, and the drum 62 will be described next. FIG. 7 is a longitudinal cross-sectional view of the drive side of the photosensitive unit 60. More specifically, FIG. 7 is a view of the photosensitive unit 60 cut along the rotational axis of the drum 62 and viewed in a direction orthogonal to the rotational axis of the drum 62.

The drive-side flange 63 includes a flange wall (corresponding to a restricted portion or a first restricted portion) 63*a* that protrudes towards the outside (a radial direction) of the drum 62 in a direction intersecting the rotational axis of the drum 62 (an orthogonal direction in the present embodiment). The flange wall 63*a* is located on the outer side of the photosensitive cylinder 62*b* in the radial direction of the photosensitive cylinder 62*b* having a cylindrical shape. The drive-side flange 63 includes a drive receiving portion 63*c* that receives drive from the apparatus main body A and a sliding portion 63*b* serving as a shaft portion supported by the hole portion 73*a*. As illustrated in FIG. 4, the drive receiving portion 63*c* has a twisted and polygonal protruded shape.

The drum supporting frame 71 includes a frame wall (corresponding to a restricting portion or a first restricting portion) 71*m* configured to abut against the flange wall 63*a* when the drum 62 moves in the direction of the rotational axis.

FIG. 8 is a cross-sectional view of the drive side of the photosensitive unit 60. More specifically, FIG. 8 illustrates the photosensitive unit 60 in which the photosensitive unit 60 has been cut in a direction orthogonal to the rotational axis of the drum 62. Furthermore, FIG. 8 is a view of the outer side of the photosensitive unit 60 in the longitudinal direction viewed in the direction of the rotational axis from a position inside the frame wall 71*m* in the longitudinal direction.

As illustrated in FIG. 8, the frame wall 71*m* protrudes towards the drum 62 in the direction orthogonal to the rotational axis. In other words, the frame wall 71*m* protrudes towards the hole portion 73*a* in the direction orthogonal to the rotation axis. As illustrated in FIG. 8, the frame wall 71*m* and the flange wall 63*a* are disposed so as to overlap each other when viewed in the direction of the rotational axis of the drum 62. In other words, in the direction of the rotational axis, the flange wall 63*a* has a portion opposing the frame wall 71*m*. Accordingly, when the flange wall 63*a* and the frame wall 71*m* are projected on a plane orthogonal to the rotational axis of the drum 62 along the rotational axis of the drum 62, an area where the flange wall 63*a* is projected and an area where the frame wall 71*m* is projected overlap each other. In the present embodiment, a portion where the area in which the flange wall 63*a* is projected and the area in which the frame wall 71*m* is projected overlap each other has a width W.

The relationship between the frame wall 71*m* and the flange wall 63*a* can also be expressed as follows. A circle drawn by the drive-side flange 63 when the drum 62 rotates around the rotational axis is referred to as a first circle 63R1. Note that first circle 63R1 is the same as the circle drawn by the flange wall 63*a*. In the above, the first circle 63R1 and the frame wall 71*m* are disposed so as to overlap each other when viewed in the direction of the rotational axis. In other words, a portion (a distal end portion) of the frame wall 71*m* is located inside the first circle 63R1. In the present embodiment, the flange wall 63*a* and the frame wall 71*m* overlap each other by an overlapping amount OL in the direction orthogonal to the rotational axis and in the radial direction of the flange wall 63*a* (same as the radial direction of the first circle 63R1). Note that there is a gap between the frame wall 71*m* and the photosensitive cylinder 62*b* in the direction orthogonal to the rotational axis of the drum 62.

In the direction of the rotational axis of the drum 62, the frame wall 71*m* is provided inside the flange wall 63*a*. As illustrated in FIG. 7, in the direction of the rotational axis of the drum 62, when the drum 62 moves in an MA direction, the frame wall 71*m* abuts against the flange wall 63*a* before the sliding portion 63*b* disengages from the hole portion 73*a*, and the movement of the drum 62 is restricted. In other words, in the direction of the rotational axis, a moving distance required to disengage the sliding portion 63*b* from the hole portion 73*a* is larger than a moving distance required for the frame wall 71*m* and the flange wall 63*a* to abut against each other. As illustrated in FIG. 7, the frame wall 71*m* is configured to abut against the flange wall 63*a* when the drum 62 moves toward the nondrive side from the drive side in the direction of the rotational axis. With the above, the movement of the drum 62 towards the inside (or towards a center point) of the drum supporting member 73 in the direction of the rotational axis is restricted. In other words, by abutting against the flange wall 63*a*, the frame wall 71*m* restricts the drum 62 from, in the direction of the rotational axis, moving in a direction from the outside towards the inside of the drum supporting member 73. As illustrated in FIG. 7, with respect to the direction of the rotational axis of the drum 62, the position of the frame wall 71*m* and the position of the hole portion 73*a* at least partially overlap each other. Since the drive-side flange 63 includes both the sliding portion 63*b* and the flange wall 63*a*, the positioning accuracy of the sliding portion 63*b* with respect to the hole portion 73*a* in the direction of the rotational axis of the drum 62 can be improved. Furthermore, in the direction of the rotational axis of the drum 62, the space for disposing the frame wall 71*m* and the hole portion 73*a* can be reduced as well.

Note that the direction from the drive side towards the nondrive side is also a direction in which the drum supporting member 73 moves from the first end portion adhered to the drum supporting frame 71 towards the second end portion on the opposite side of the first end portion.

Method of Recycling Cartridge

A method of recycling the cartridge B is described below.

When a formation of an image using the cartridge B mounted in the apparatus main body A is repeated, the toner T accommodated in the toner chamber 29 becomes consumed. Furthermore, the photosensitive layer of the photosensitive cylinder 62*b* of the drum 62 also decreases. Subsequently, when an image having a quality required by the user cannot be formed anymore, the cartridge B reaches the end of its product life.

The used cartridge B can be used again by collecting and recycling the use cartridge B. The recycling process of cartridge B includes, cleaning of the cartridge B, replacement of parts, and the like.

Note that cartridge B served as the material for the recycling does not need to be used until the end of its product life.

Furthermore, the parts of the cartridge B may be, as it is, recycled or may be replaced with new parts. Furthermore, when a part of the cartridge B is reused, the cartridge from which the part has been removed and the cartridge on which the removed part is mounted do not need to be the same.

In the description hereinafter, separating a unit or a part included in the cartridge B from the cartridge B can be referred to as a disassembling step (a disassembling method) of the cartridge.

Separating Developing Unit and Photosensitive Unit from Each Other

Referring to FIGS. 4 and 5, a process of separating the developing unit 20 from the photosensitive unit 60 (a unit separating step) will be described.

The cartridge B described above is first prepared (a preparation step). Subsequently, in order to separate the developing unit 20 and the photosensitive unit 60 from each other, the screw 12 connecting the drum supporting frame 71 and the drum supporting member 73 to each other is removed.

Subsequently, in a state in which the drum supporting member 73 is adhered to the drum supporting frame 71, the drum supporting member 73 is deformed. Specifically, a portion of the drum supporting member 73 covering the engagement portion of the first suspension hole 71*i* and the developing-unit first support boss 26*a* is deformed. Subsequently, the developing unit 20 is moved in a direction opposite to the arrow G, and the developing unit 20 and the photosensitive unit 60 are separated from each other.

As described above, the photosensitive unit 60 is separated from the cartridge B served as the material for the recycling. Note that separated photosensitive unit 60 can be referred to as a material unit, or the first unit, which is to be a material for manufacturing a new photosensitive unit or a new frame unit described later.

Drum Separating Step

Referring next to FIGS. 1A to 1C, 6, 7, 8, and 18, a separating step in which the separated photosensitive unit 60 is disassembled and in which the drum 62 is separated from the photosensitive unit 60 will be described.

Figure 1A:
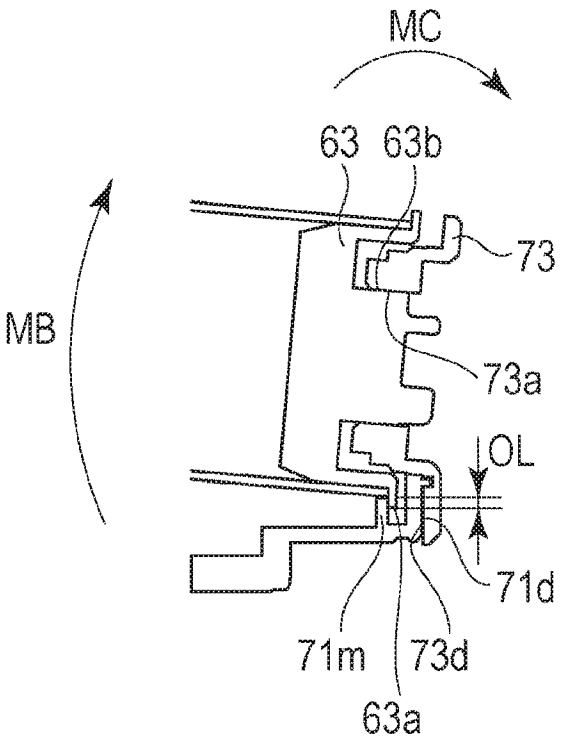
FIGS. 1A to 1C are the diagrams illustrating a separating step of separating a photosensitive drum from a photosensitive unit.
Figure 1B:
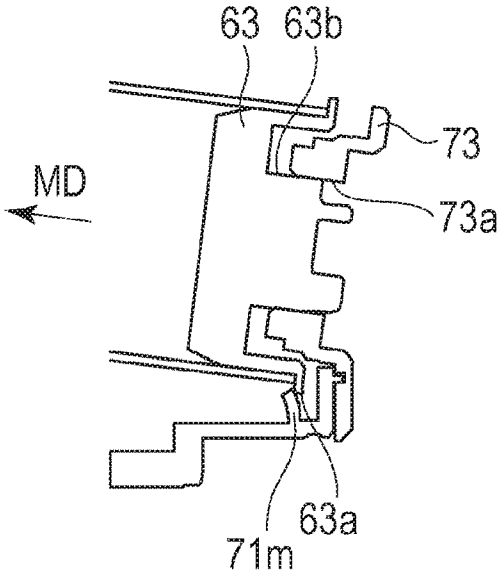
Figure 1C:
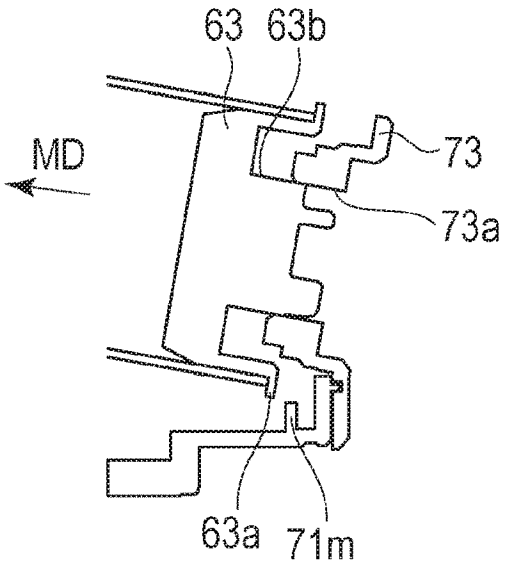
Figure 6:
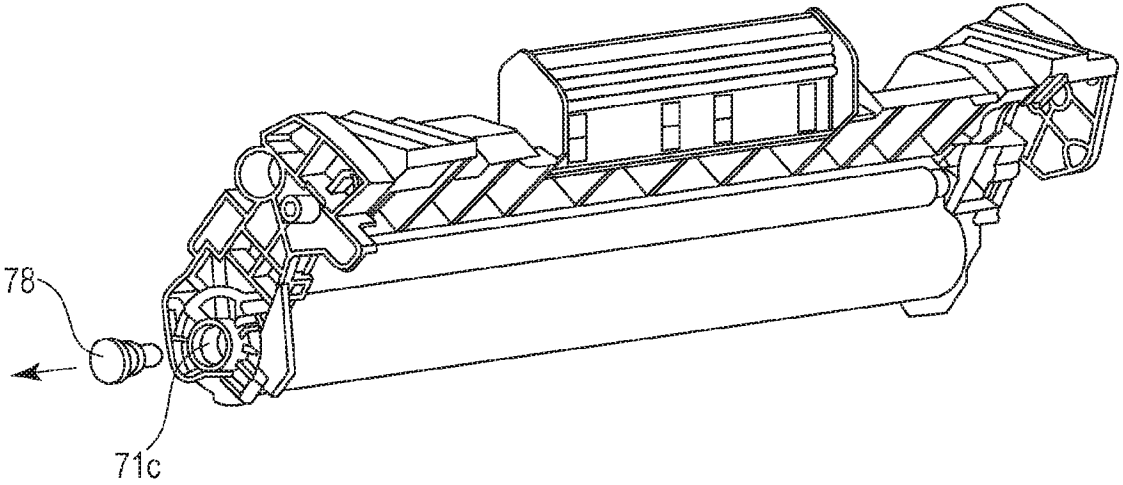
FIG. 6 is a perspective view of the photosensitive unit.
Figure 18:
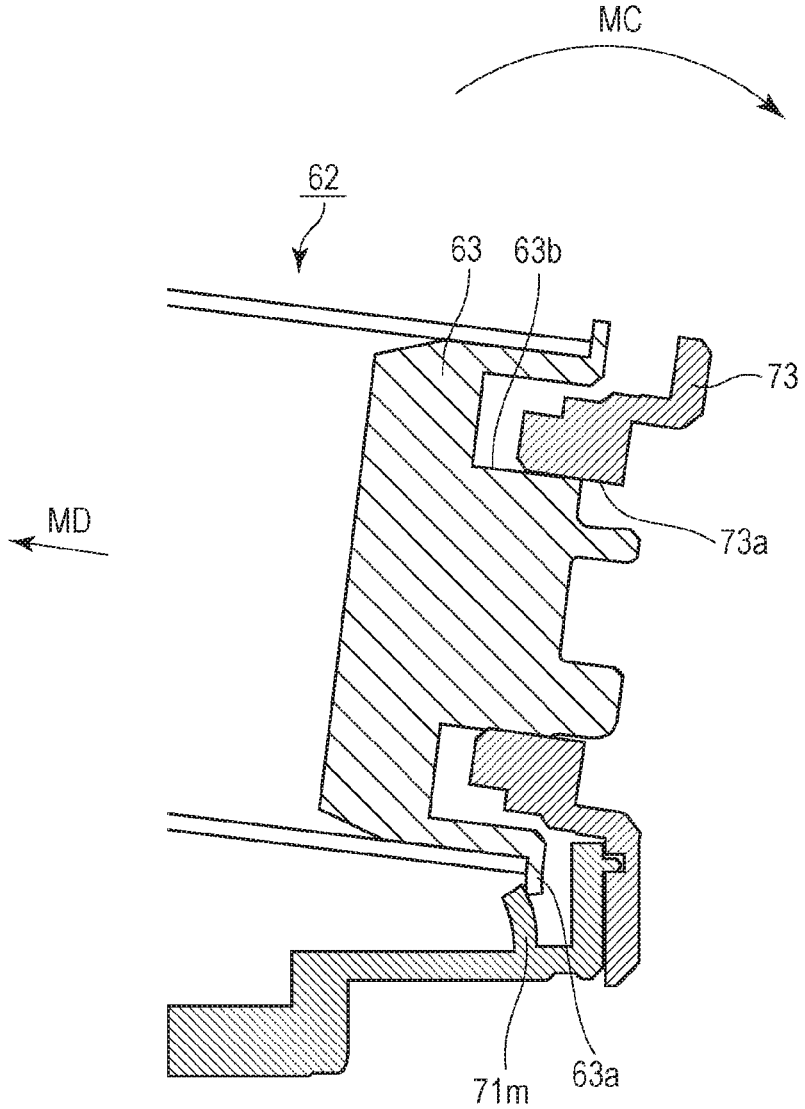
FIG. 18 is an enlarged view illustrating a separating step in which the photosensitive drum is separated from the photosensitive unit.

FIG. 6 is a perspective view of the photosensitive unit 60. More specifically, FIG. 6 is a perspective view illustrating a step of separating the drum shaft 78 from the photosensitive unit 60. FIGS. 1A to 1C illustrate steps of separating the drum 62 from the photosensitive unit 60. FIG. 1A illustrates of separating the drum shaft 78 from the photosensitive unit 60. FIG. 1B illustrates a state in which the frame wall 71*m* is deformed during separation of the drum shaft 78 from the photosensitive unit 60. FIG. 1C illustrates a state in which the drum 62 is separated from the drum supporting member 73. FIG. 18 is an enlarged view illustrating the separating step in which the drum 62 is separated from the photosensitive unit 60. More specifically, FIG. 18 is an enlarged view illustrating a state in which the frame wall 71*m* has been deformed, similar to FIG. 1B.

The separating step of separating the drum 62 serving as a first image carrying member from the drum supporting member 73 will be described. Specifically, the separating step of the drum 62 refers to a step in which the sliding portion 63*b* of the drive-side flange 63 is separated from the hole portion 73*a* of the drum supporting member 73. In the following description, the separating step described above may be expressed as separating the drum 62 from the photosensitive unit 60, separating the drum 62 from the drum supporting frame 71, and separating the drum 62 from the drum supporting member 73.

In the present embodiment, the drum 62 is separated while in a state in which at least a portion of the drum supporting member 73 is adhered to the drum supporting frame 71. More specifically, the drum 62 is separated from the drum supporting member 73 while in a state in which a portion including the hole portion 73*a* of the drum supporting member 73 is fixed to the drum supporting frame 71. In other words, there is no need to provide a step of removing the drum supporting member 73 from the drum supporting frame 71 in order to separate the drum 62 from the drum supporting member 73 because the drum 62 can be separated from the drum supporting member 73 without having to separate the drum supporting member 73 from the drum supporting frame 71. Furthermore, with the above, when attaching the new drum 162 described later to the drum supporting member 73, the new drum 162 can be attached with an accuracy similar to that of the drum 62.

As Illustrated in FIG. 6, when taking out the drum 62, first, the drum shaft 78 press-fitted into the hole portion 71*c* of the drum supporting frame 71 is pulled out in the direction of the rotational axis of the drum 62 toward the nondrive side.

As illustrated in FIG. 7, subsequently, in order to disengage the sliding portion 63*b* of the drive-side flange 63 and the hole portion 73*a* of the drum supporting member 73 from each other, the drum 62 is moved in the arrow MA direction. Then, before the sliding portion 63*b* and the hole portion 73*a* are disengaged from each other, the frame wall 71*m* of the drum supporting frame 71 and the flange wall 63*a* of the drive-side flange 63 come into contact (interfere) with each other.

Accordingly, a deforming step of deforming the frame wall 71*m* is performed. Specifically, as illustrated in FIG. 1A, in a state in which the frame wall 71*m* and the flange wall 63*a* abut against each other, the nondrive side of the drum 62 is moved in an arrow MB direction. With the above, in a state in which the sliding portion 63*b* of the drive-side flange 63 and the hole portion 73*a* of the drum supporting member 73 abut against each other, the drum supporting member 73 is elastically deformed in an arrow MC direction. Furthermore, when the drum 62 is moved in the arrow MB direction, the frame wall 71*m* is elastically deformed as illustrated in FIGS. 1B and 18. In the above, there may be a case in which the flange wall 63*a* becomes deformed as well. When the drum supporting member 73 is further deformed in the arrow MC direction, the plane of projection of the flange wall 63*a* and the plane of projection of the frame wall 71*m* do not overlap each other in an arrow MD direction, which is a direction in which the drum 62 is taken out. In other words, the overlapping amount OL of the flange wall 63*a* and the frame wall 71*m* viewed in the axial direction of the tilted drum 62 decreases. Furthermore, compared with before the deformation, the distance between the frame wall 71*m* and the periphery of the hole portion 73*a* is increased. With the above, as illustrated in FIG. 1C, the drum 62 becomes movable in the arrow MD direction with respect to the drum supporting member 73; accordingly, the drum 62 is allowed to be separated.

Note that in the present embodiment, when application of force to the drum 62 in the arrow MB direction is stopped, the distance between the frame wall 71*m* and the hole portion 73*a* returns to its original distance due to the elasticity of the frame wall 71*m* and the hole portion 73*a*. However, the frame wall 71*m* may be plastically deformed. Note that the plastic deformation referred to herein includes plastic deformation in which the frame wall 71*m* is fractured. Furthermore, in a state in which the frame wall 71*m* is deformed, a fixing step in which the frame wall 71*m* is fixed with an adhesive agent or the like may be performed. For example, in a state illustrated in FIG. 18, an adhesive agent or the like may be applied to a base of the frame wall 71*m*. By so doing, unintentional separation of the frame wall 71*m* from the drum supporting frame 71 is prevented.

Another method of separating the drum 62 from the drum supporting member 73 will be described next.

Figure 9:
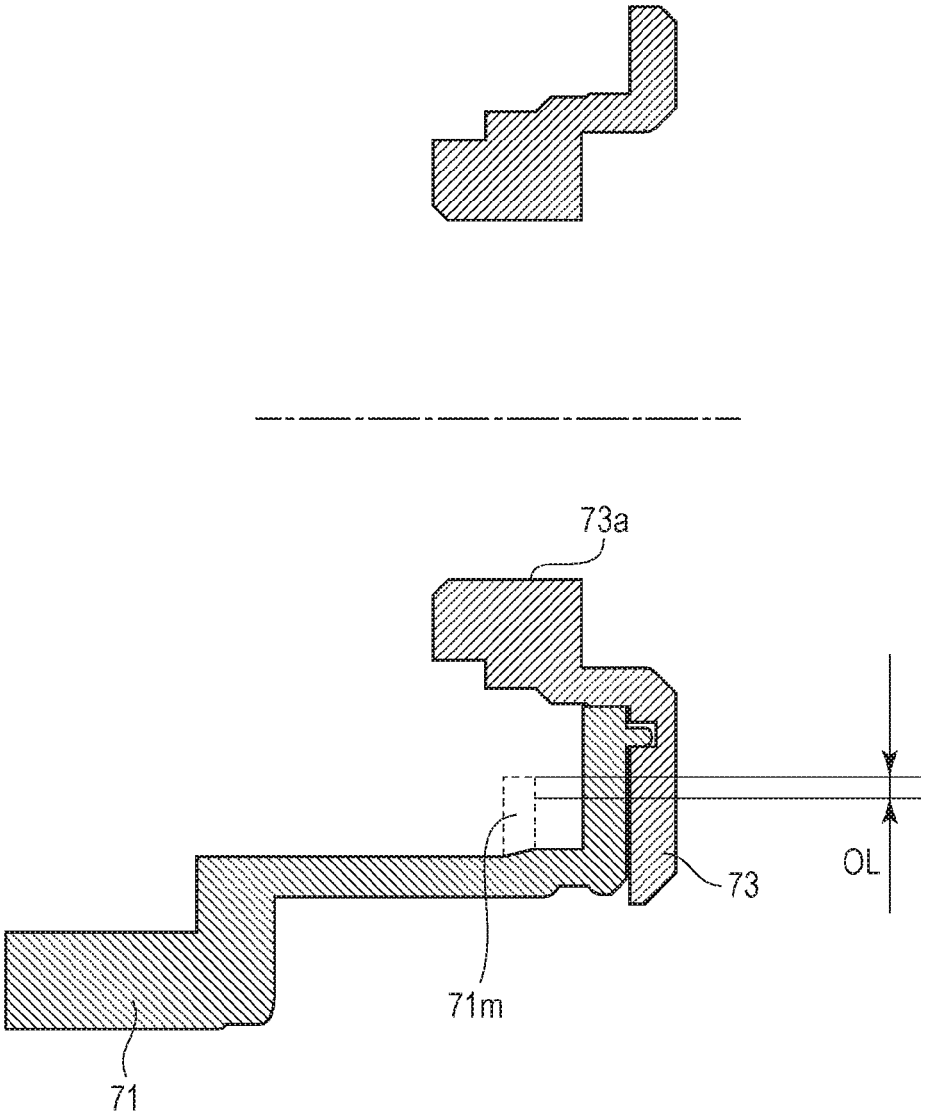
FIG. 9 is a cross-sectional view of a drum supporting frame and a drum supporting member according to a first embodiment.

In the step of separating the drum 62 from the photosensitive unit 60, the drum 62 may be separated while removing at least a portion of the frame wall 71*m* as illustrated in FIG. 9 described later. In the above, it is desirable that the frame wall 71*m* is removed to the extent that the overlapping amount OL of the frame wall 71*m* is 0. Note that a portion of the frame wall 71*m* may be left remaining or all of the frame wall 71*m* may be removed. Note that the frame wall 71*m* may be removed by displacement of the drum 62.

Furthermore, as another method, the drum 62 may be separated after at least a portion of the flange wall 63*a* of the drive-side flange 63 has been removed. For example, the entire circumference of the flange wall 63*a* is removed in the rotation direction of the drum 62. In so doing, the drive-side flange 63 is formed so as to have a shape similar to that illustrated in FIG. 14 described later.

Furthermore, a portion of the flange wall 63*a* may be removed so that a recessed portion recessed toward the rotational axis is formed in a portion of the flange wall 63*a*. In such a case, in the rotation direction of the drum 62, a length of the removed portion (the recessed portion) of the flange wall 63*a* is, desirably, longer than a length of the frame wall 71*m*. In other words, desirably, a width of the removed portion of the flange wall 63*a* is larger than the width W of the frame wall 71*m*. In so doing, the drive-side flange 63 is formed so as to have a shape similar to that illustrated in FIG. 15 described later.

By so doing, the drum 62 can be separated so that the frame wall 71*m* passes through the removed portion of the flange wall 63*a*.

In either case, in the step of separating the drum 62, separation of the drum 62 is facilitated by reducing the amount of contact between the flange wall 63*a* and the frame wall 71*m*. Note that it is desirable that the flange wall 63*a* and the frame wall 71*m* are removed so that the flange wall 63*a* and the frame wall 71*m* do not come into contact with each other in the step of separating the drum 62. Furthermore, both the flange wall 63*a* and the frame wall 71*m* may be removed or the like. Note that the removing step and the deforming step of the frame wall 71*m* described herein can also be referred to as an example of a distance increasing step described later.

As described above, the drum 62 serving as the first image carrying member can be separated from the drum supporting member 73. With the above, a frame unit allowing the photosensitive unit 60 to be disassembled and allowing a new drum (including reuse of the drum 62) to be attached can be manufactured. The manufacturing step of the frame unit described above can also be referred to as a disassembling step of the photosensitive unit 60.

Furthermore, as described above, by performing a gap increasing step in the above step, installation of the new drum 162 becomes even more easier. The drum 62 is separated from the drum supporting member 73 while in a state in which the portion including the hole portion 73*a* of the drum supporting member 73 is fixed to the drum supporting frame 71. With the above, the position accuracy of the drum 62 and the position accuracy of the new drum 162 can be similar in the direction orthogonal to the rotational axis. Furthermore, there is no need to rip off the drum supporting member 73 from the drum supporting frame 71. In other words, a frame unit in which a new drum 162 described later can be positioned accurately can be manufactured easily.

Manufacturing of Second Image Carrying Member

A step of manufacturing the new drum 162 serving as a second image carrying member will be described next. The new drum 162 is a drum replacing the removed drum 62.

After separating the drum 62 from the drum supporting member 73, the drive-side flange 63 is separated from the drum 62. Subsequently, the drive-side flange 63 is attached to a new photosensitive cylinder 162*b*, and the new drum 162 is manufactured. In so doing, a fixing method of the drive-side flange 63 is not limited to any method as long as an adhesive agent, a screw, a pin, or the like is used, and the photosensitive cylinder 162*b* and the drive-side flange 63 are integrally rotatable.

Note that if the drum 62 is in a reusable state, the drum 62 may be used as the new drum 162 without separating the drive-side flange 63. Furthermore, after the drive-side flange 63 has been separated, the drum 62 combined with the photosensitive cylinder 62*b* once again may be used as the new drum 162. Furthermore, a used photosensitive cylinder 62*b* removed from another cartridge B, for example, may be used as the photosensitive cylinder 162*b*. Furthermore, a newly manufactured drive-side flange 63 combined with the photosensitive cylinder 162*b* may be used as the new drum 162. Furthermore, a drum in which all of the parts are newly manufactured may be used as the new drum 162. In other words, the part to be exchanged and the part to be reused may be selected according to the state of the drum 62.

In the following description, a step of joining a new drum 162 with the drum supporting frame 71 is illustrated; however, the new drum 162 may be a drum manufactured by either of the manufacturing methods. In other words, the new drum 162 also includes a drum in which a portion of or all of the drum 62 are reused as they are.

Hereinafter, the new drum 162 described above is merely referred to as a drum 162.

Step of Reducing Height of Frame Wall

Figure 19:
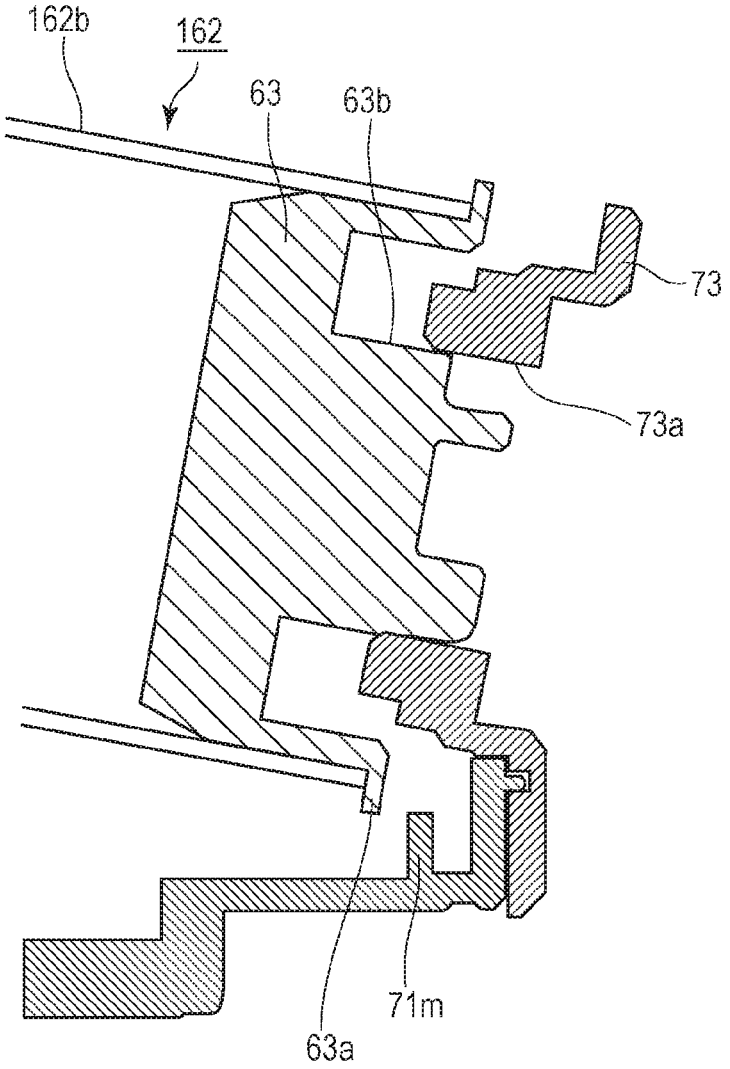
FIG. 19 is an enlarged view illustrating attaching of the photosensitive drum.

Referring to FIGS. 9 and 19, a step of reducing a height of the frame wall 71*m* in the direction orthogonal to the rotational axis will be described. Note that the height of the frame wall 71*m* described herein is a length from the base to the distal end of the frame wall 71*m*. In other words, the step of reducing the height of the frame wall 71*m* is the distance increasing step (the gap increasing step) in which the distance (the gap) between the frame wall 71*m* and the rotational axis in the direction orthogonal to the rotational axis is increased. By reducing the height of the frame wall 71*m*, the frame wall 71*m* becomes distanced away from the rotational axis and the hole portion 73*a* in the direction orthogonal to the rotational axis. In other words, the distance (the gap) between the frame wall 71*m* and the hole portion 73*a* increases in the direction orthogonal to the rotational axis.

In the following description, a case in which the flange wall 63*a* is not removed nor plastically deformed when the drum 62 is separated from the drum supporting member 73 will be described as an example.

FIG. 9 is a cross-sectional view of the drum supporting frame 71 and the drum supporting member 73. FIG. 19 is an enlarged view illustrating attachment of the drum 162.

As described above, the drum supporting frame 71 includes the frame wall 71*m*. The drive-side flange 63 includes the flange wall 63*a*. Accordingly, as illustrated in FIG. 19, when attaching the drum 162, the frame wall 71*m* and the flange wall 63*a* abut against each other before the sliding portion 63*b* and the hole portion 73*a* engage with each other.

Accordingly, as illustrated in FIG. 9, at least a portion of the frame wall 71*m* provided in the drum supporting frame 71 is removed (a removing step). Specifically, in the direction orthogonal to the rotational axis, the frame wall 71*m* is removed in a direction distancing away from the rotational axis. In other words, in the direction orthogonal to the rotational axis, at least a portion of the frame wall 71*m* is removed so that the gap (the distance) between the frame wall 71*m* and the rotational axis increases. In other words, in the direction orthogonal to the rotational axis, the distance (the gap) between the frame wall 71*m* and the hole portion 73*a* increases.

With the above, the amount by which the frame wall 71*m* and the flange wall 63*a* abut against each other decreases, and joining of the drum 162 to the drum supporting frame 71 (joining of the drum 162 to the drum supporting member 73) becomes easy. In the above, it is better that the amount by which the frame wall 71*m* is removed is equivalent to or larger than the overlapping amount OL described above. In other words, it is desirable that the frame wall 71*m* is removed so that the frame wall 71*m* does not come into contact with the flange wall 63*a*.

Note that when the frame wall 71*m* is removed in the above-described step of separating the drum 62 from the photosensitive unit 60, the separating step can be deemed as the removing step.

Furthermore, as illustrated in FIG. 1B, the deforming step of deforming the frame wall 71*m* with respect to the drum supporting frame 71 may be performed. The gap (the distance) between the rotational axis and the frame wall 71*m* can be increased in the above manner as well. In so doing, the frame wall 71*m* may be plastically deformed. Furthermore, in order to stabilize the position of the frame wall 71*m*, the fixing step of fixing the frame wall 71*m* to the drum supporting frame 71 or the like using an adhesive agent or the like may be performed. Note that when the frame wall 71*m* is plastically deformed or the like in the above-described step of separating the drum 62 from the photosensitive unit 60, the separating step can be deemed as the deforming step.

The frame wall 71*m* is desirably removed or deformed so that the frame wall 71*m* and the flange wall 63*a* do not contact each other. In other words, when viewed in the direction of the rotational axis of the drum 62, desirably, the frame wall 71*m* is deformed or removed so that the frame wall 71*m* is located outside the first circle 63R1 (see FIG. 8).

It can also be stated that the gap increasing step above is the distance increasing step which increases the distance between the distal end of the frame wall 71*m* and the rotational axis in the direction orthogonal to the rotational axis. Furthermore, as described above, the distance increasing step (the gap increasing step) may be included in the separating step of the drum 62. The step including the removing step and the deforming step of the frame wall 71*m* described above can also be referred to as a displacing step of the frame wall 71*m*. In other words, a height reducing step and the distance increasing step of the frame wall 71*m* can be called the displacing step of the frame wall 71*m*.

With the above, the frame unit to which the drum 162 can be easily attached can be manufactured.

Drum Installing Step

A method of manufacturing a new photosensitive unit by installing the drum 162 in the frame unit manufactured in the above described manner will be described next.

Figure 10:
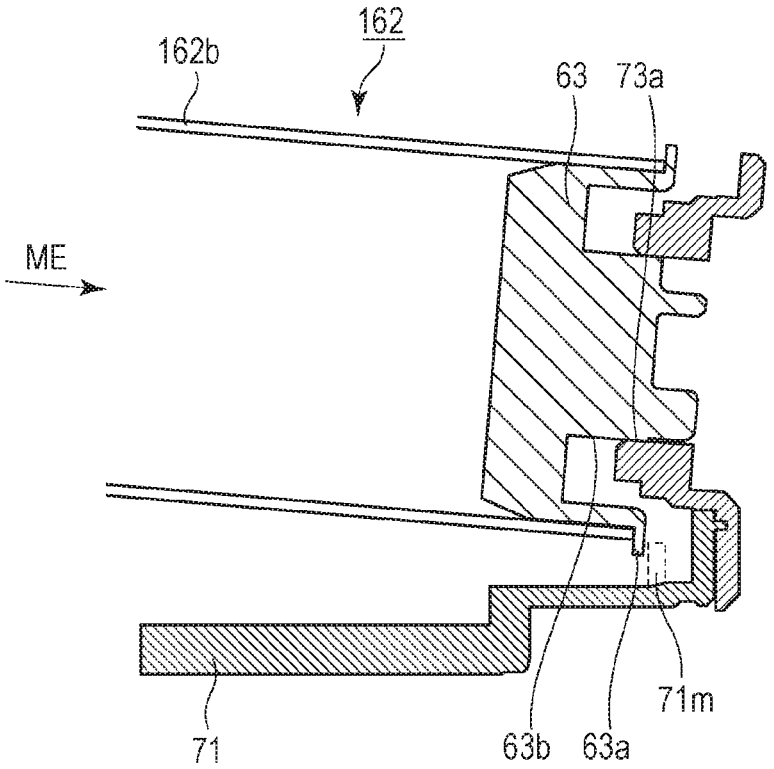
FIG. 10 is a cross-sectional view illustrating a step of attaching the photosensitive drum, according to the first embodiment.
Figure 11:
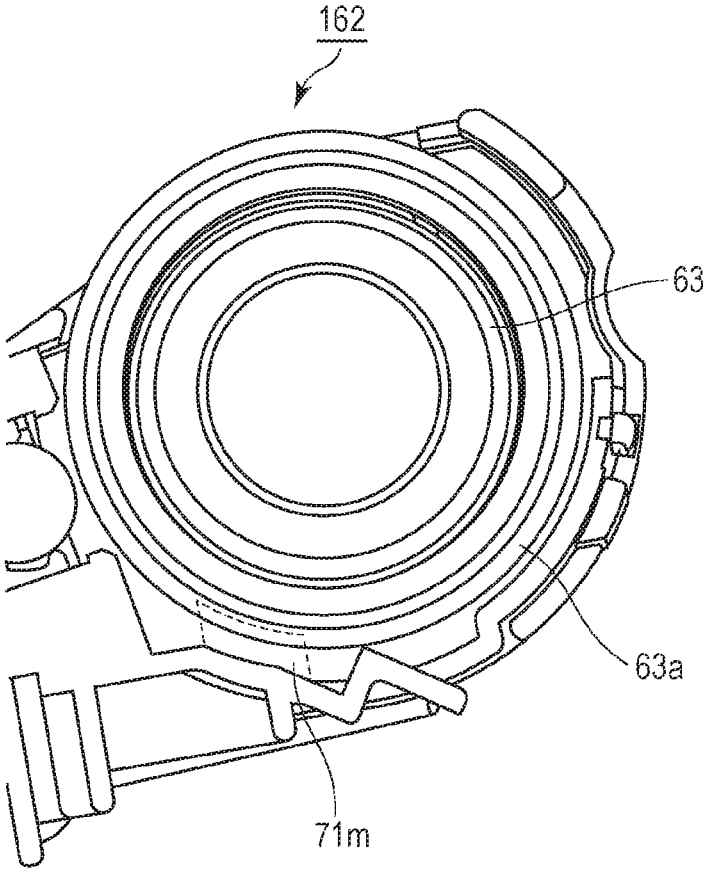
FIG. 11 is a cross-sectional view illustrating a step of attaching the photosensitive drum according to the first embodiment.

An attaching step of attaching the drum 162 will be described with reference to FIGS. 10 and 11. FIG. 10 is a cross-sectional view illustrating a step of attaching the drum 162 and is a longitudinal cross-sectional view of the drive side when installing a new drum. FIG. 11 is a cross-sectional view illustrating a step of attaching the drum 162 to the drum supporting member 73, and is a diagram illustrating a step in which the drum 162 is installed in the drum supporting member 73 after the frame wall 71*m* has been removed.

As illustrated in FIG. 10, the drum 162 is installed in an arrow ME direction into the drum supporting member 73 through the hole portion 73*a*.

In so doing, since the frame wall 71*m* is removed or deformed as described above, the drum 162 can be easily installed in the drum supporting frame 71.

In the present embodiment, as illustrated in FIG. 11, nothing overlaps the flange wall 63*a* of the drive-side flange 63 in a drum installing direction ME. As a result, the sliding portion 63*b* of the drive-side flange 63 and the hole portion 73*a* of the drum supporting member 73 can be readily engaged with each other; accordingly, the drum 162 can be readily installed in the drum supporting frame 71.

With the above, a new photosensitive unit including the drum 162 can be manufactured with the photosensitive unit 60 serving as the first unit.

Note that a step of removing the toner stored in the waste toner chamber 71*b* may be performed before attaching the drum 162 or after attaching the drum 162. Furthermore, a step of cleaning or replacing parts such as the cleaning member 77 and the charge roller 66 may be performed.

Furthermore, the gap increasing step described above may be performed by attaching the drum 162. In other words, the drum 162 is attached while in a state in which at least a portion of the frame wall 71*m* remains. Furthermore, the frame wall 71*m* may be pushed and deformed toward the outside of the drum supporting member 73 with the flange wall 63*a*. In so doing, the frame wall 71*m* may be pushed and broken by the flange wall 63*a*.

Formation of Second Frame Wall (Second Restricting Portion)

Figure 12:
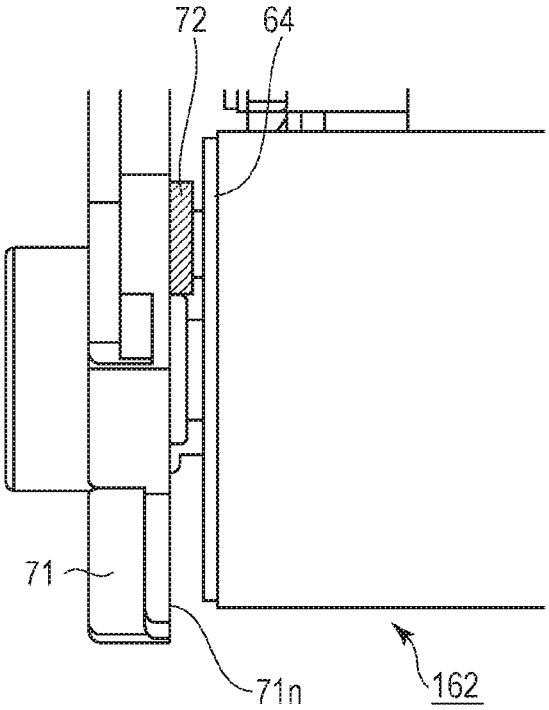
FIG. 12 is a cross-sectional view illustrating a step of attaching the photosensitive drum, according to the first embodiment.

Referring to FIG. 12, a step of forming the second restricting portion, which restricts the movement of the drum 162 in the direction of the rotational axis towards the inside of the drum supporting member 73 will be described.

FIG. 12 is an enlarged view of the nondrive side after the drum 162 has been installed. As illustrated in FIG. 12, a spacer 72 serving as the second restricting portion is attached to a wall surface 71*n* of the drum supporting frame 71 on the nondrive side. The attaching method of the spacer 72 is not limited and includes attaching with a piece of two-sided adhesive tape, an adhesive agent, pinning, or screwing. The above restricts the drum 162 from moving to the nondrive side. In other words, even when the frame wall 71*m* is removed or the like, the movement of the drum 162 can be, same as the frame wall 71*m*, restricted in the direction of the rotation axis. In other words, the spacer 72 restricts the drum 162 from moving from the first end portion towards the second end portion in the direction of the rotational axis. In other words, in the direction of the rotational axis of the drum 162, the spacer 72 restricts the movement of the drum 162 in the direction from the outside towards the inside of the drum supporting member 73.

Although the spacer 72 is provided on the drum supporting frame 71 in the present embodiment, it is only sufficient that the movement of the drum 162 towards the nondrive side is restricted, and the spacer 72 may be provided on a nondrive-side drum flange 64 of the drum 162.

In the present embodiment, the spacer 72 is attached after the drum 162 is installed in the drum supporting frame 71; however, the spacer 72 may be attached before the installation of the drum 162.

As described above, a new photosensitive unit 60 including the drum 162 can be manufactured with the photosensitive unit 60 serving as the first unit.

Step of Disassembling Developing Unit and Other Steps

A step of disassembling the developing unit and a step of manufacturing a new cartridge with a new photosensitive unit will be described.

After the photosensitive unit 60 is separated, disassembling of the developing unit 20 and refilling of toner are performed. In the separated developing unit 20, the bearing member 26 and the bearing member 27 are removed from the developer container 23. Furthermore, the development roller 32 and the developing blade 42 are removed from the developer container 23. Furthermore, cleaning or replacing of the parts of the developer container 23, the development roller 32, and the developing blade 42 is performed as needed.

Subsequently, new toner T is refilled in the toner chamber 29 of the developer container 23. Refilling of the toner is performed, for example, through a toner supply opening 23*d* (FIG. 3) of the developer container 23 while in a state in which the development roller 32 and the developing blade 42 have been removed. In so doing, the developer container 23 is held so that the toner supply opening 23*d* faces upward, and a funnel (not shown) having a tip whose size is substantially the same as or smaller than that of the toner supply opening 23*d* is placed in the toner supply opening 23*d*. Subsequently, a predetermined amount of toner T is filled in the toner chamber 29 from the funnel through the toner supply opening 23*d*.

The developing unit 20 is assembled next. When filling of the toner is completed, next, the toner supply opening 23*d* is sealed with a sealing member (not shown). Subsequently, in the reverse order of the disassembling of the developing unit 20, the development roller 32, the developing blade 42, the bearing member 26, and the bearing member 27 are installed in the developer container 23. The reassembling of the developing unit 20 is completed with the above.

Finally, the developing unit 20 containing the new toner T is joined to the new photosensitive unit to which the drum 162 has been attached in the above described manner (a joining step). A cartridge is manufactured in the above manner.

Note that the developing unit 20 may be a newly manufactured developing unit. Alternatively, a developing unit 20 separated from another cartridge B may be used.

As described above, a new cartridge can be manufactured by recycling a cartridge B served as the material for the recycling.

Second Embodiment

Subsequently, a second embodiment of the present disclosure will be described with reference to FIGS. 13 to 17.

Note that in the present embodiment, portions that are different from those of the embodiment described above will be described in detail. Unless described again, the materials and the shapes are similar to those of the embodiment described above. Such components will be attached with the same reference numerals and detailed description thereof will be omitted.

In the first embodiment, the frame wall 71*m* is removed or deformed; however, the present embodiment is different from the first embodiment in that at least a portion of the flange wall 63*a* is removed, or the like.

Note that the same steps as those of the first embodiment can be used as the step of separating the photosensitive unit 60 and the developing unit 20 from each other and the step of separating the drum 62 from the photosensitive unit 60; accordingly, description thereof will be omitted herein.

Manufacturing Second Edge Portion Member

Manufacturing of a new drive-side flange 163 serving as a second edge portion member will be described with reference to FIGS. 13, 14, 15, and 16.

Figure 13:
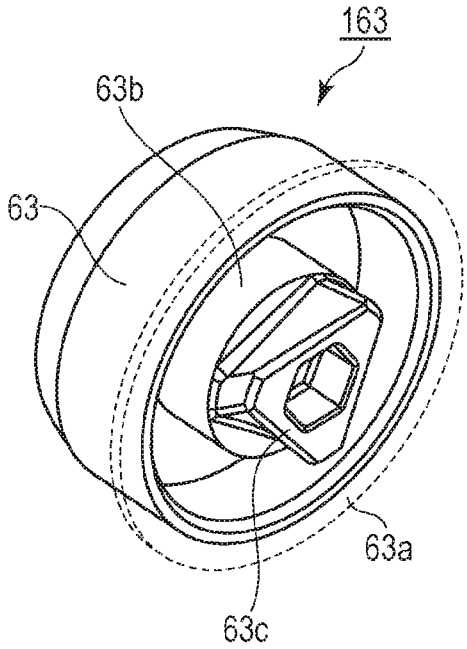
FIG. 13 is a perspective view of a drive-side flange according to a second embodiment.
Figure 14:
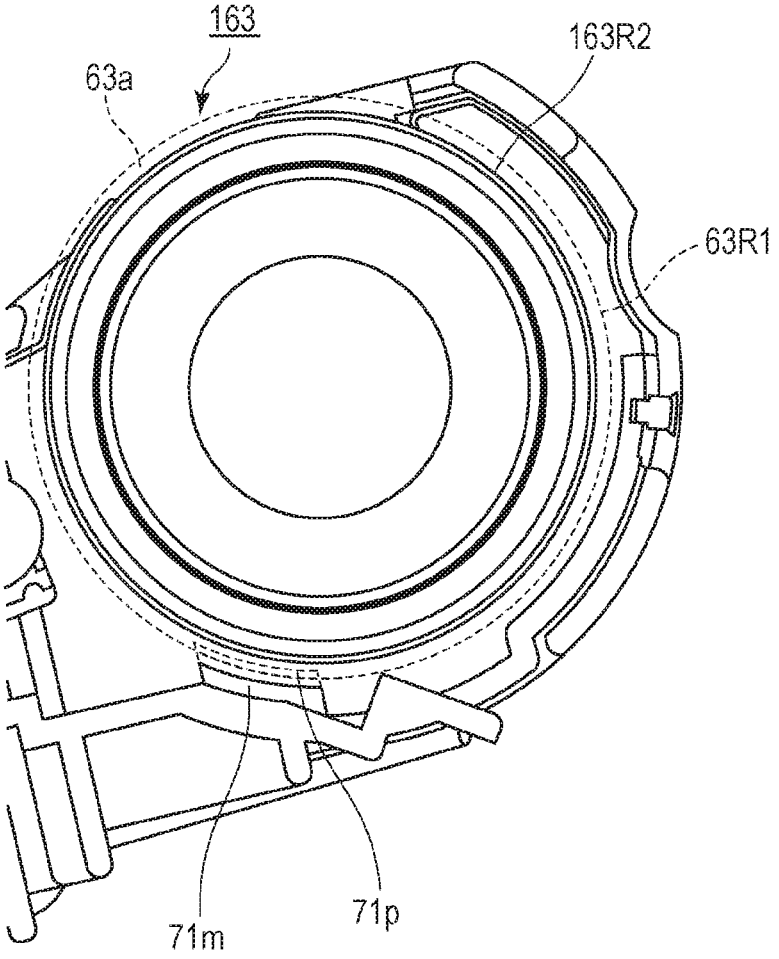
FIG. 14 is a cross-sectional view of a photosensitive unit according to the second embodiment.
Figure 15:
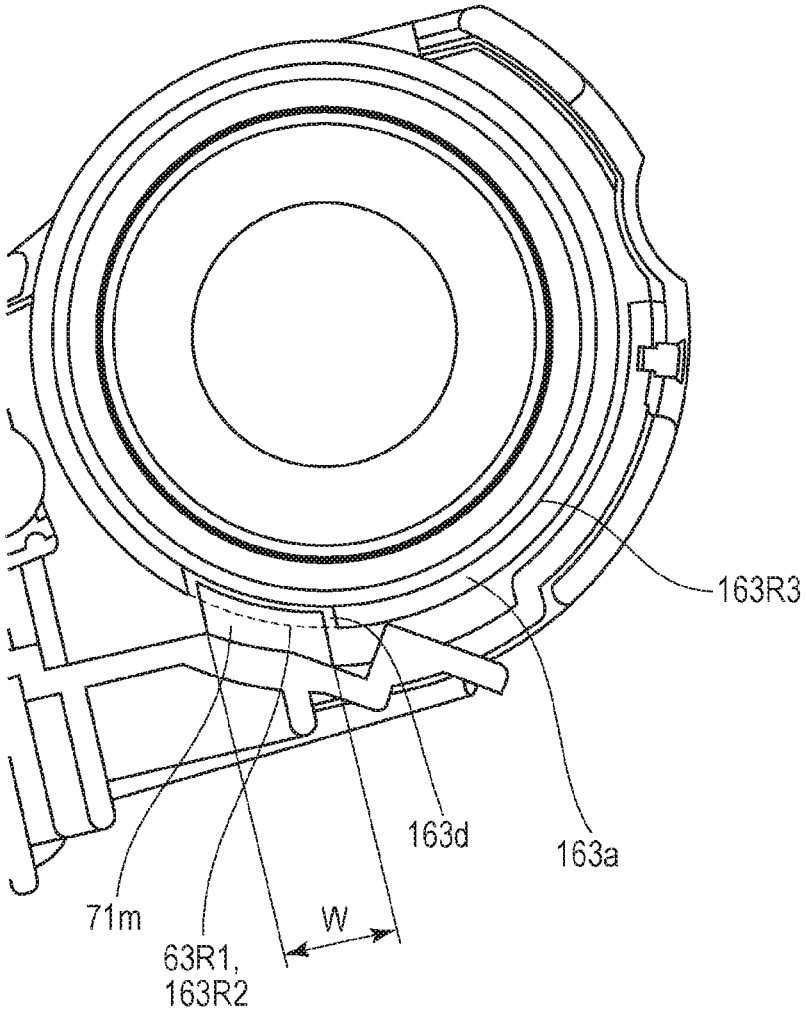
FIG. 15 is a cross-sectional view of the photosensitive unit according to the second embodiment.
Figure 16:
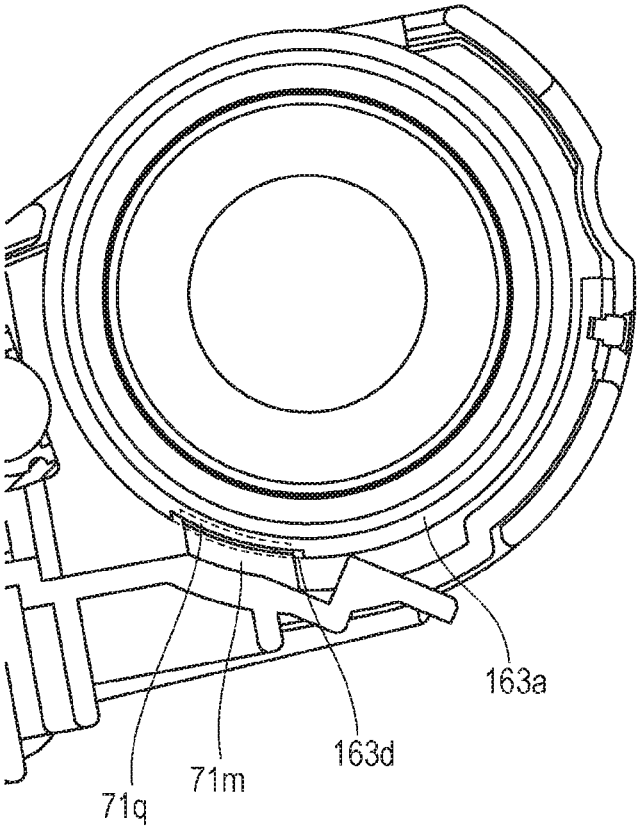
FIG. 16 is a cross-sectional view of the photosensitive unit according to the second embodiment.

FIG. 13 is a perspective view of the new drive-side flange 163 serving as the second edge portion member according to the present embodiment. FIGS. 14 to 16 are cross-sectional views of a new photosensitive unit according to the present embodiment.

As illustrated in FIG. 13, at least a portion of the flange wall 63*a* of the drive-side flange 63 is removed, and the drive-side flange 163 serving as the second edge portion member is manufactured. Note that the removing of the flange wall 63*a* may be carried out without separating the drive-side flange 63 from the drum 62. Furthermore, the flange wall 63*a* may be removed after removing the drive-side flange 63 from the drum 62.

The flange wall 63*a* is removed so that the amount thereof protruding towards the outside of the drum 162 decreases in the direction orthogonal to the rotational axis so that the amount in contact with the frame wall 71*m* decreases. In the above, the entire flange wall 63*a* may be removed. Furthermore, in the direction orthogonal to the rotational axis (in a radial direction of the photosensitive cylinder 162*b*), the flange wall 63*a* may be removed so that the edge of the flange wall 63*a* is located inside the photosensitive cylinder 162*b*.

For example, as illustrated in FIG. 14, the entire circumference of the flange wall 63*a* in the circumferential direction may be removed. In the above, when viewed in the direction of the rotational axis, a size of a region where the new drive-side flange 163 and the frame wall 71*m* overlap each other is smaller than a size of a region where the flange wall 63*a* and the frame wall 71*m* overlap each other. Note that when viewed in the direction of the rotational axis, the flange wall 63*a* may be removed so that a gap is formed between the new drive-side flange 163 and the frame wall 71*m*. In other words, the size of the region where the new drive-side flange 163 and the frame wall 71*m* overlap each other when viewed in the direction of the rotational axis may be 0 or less.

In other words, when the drum 162 rotates about the rotational axis, the drive-side flange 163 depicts a second circle 163R2 (FIG. 14). Furthermore, when viewed in the direction of the rotational axis, the second circle 163R2 is smaller than the first circle 63R1 depicted by the flange wall 63*a*. In other words, a radius (a maximum radius) of the second circle 163R2 is smaller than a radius (a maximum radius) of the first circle 63R1.

By so doing, the step of installing the drum 162 in the drum supporting member 73 can be facilitated.

Note that when viewed in the direction of the rotational axis, desirably, the flange wall 63*a* is removed so that the frame wall 71*m* is located outside the second circle 163R2.

Note that the amount by which the flange wall 63*a* is removed in the radial direction of the second circle 163R2 do not have to be uniform in the circumferential direction of the second circle 163R2 and a recessed portion may be formed in a portion thereof.

Furthermore, as illustrated in the first embodiment, the frame wall 71*m* may be removed or deformed. In other words, the distance increasing step (the gap increasing step) illustrated in the first embodiment may be performed as well. In such a case, as illustrated in FIG. 14, desirably, the flange wall 63*a*, or both the flange wall 63*a* and the frame wall 71*m* are removed so that a region 71*p* is absent.

By so doing, the step of installing the drum 162 in the drum supporting member 73 can be facilitated. In other words, since the plane of projection of the drive-side flange 163 and the plane of projection of the frame wall 71*m* do not overlap each other in the drum installing direction ME, a new drum 162 can be easily installed in the drum supporting frame 71.

On the other hand, a portion of the flange wall 63*a* may be removed. The above will be described below with reference to FIG. 15.

In the above method, a portion of the flange wall 63*a* of the drive-side flange 63 is removed so that a flange wall 163*a* of the new drive-side flange 163 is provided with a recessed portion 163*d* recessed towards the rotational axis. The flange wall 163*a* provided with the recessed portion 163*d* corresponds to the second restricted portion. In the above method, the flange wall 163*a* is a portion of the flange wall 63*a* that remains without being removed.

As illustrated in FIG. 15, when the new drum 162 rotates around the rotational axis, the flange wall 163*a* of the new flange 163 draws the second circle 163R2 when viewed in the direction of the rotational axis. Furthermore, the recessed portion 163*d* draws a third circle 163R3.

In the above, when viewed in the direction of the rotational axis, the second circle 163R2 is the same as the first circle 63R1. On the other hand, the third circle 163R3 is located inside the second circle 163R2 and the first circle 63R1.

In other words, the amount of contact with the frame wall 71*m* is decreased in the recessed portion 163*d*. More desirably, as illustrated in FIG. 15, it is desirable that the frame wall 71*m* is located outside the third circle 163R3 when viewed in the direction of the rotational axis. Furthermore, in the rotation direction of the drum 162, the length of the recessed portion 163*d* is, desirably, longer than the length of the frame wall 71*m*.

Furthermore, as illustrated in FIG. 16, the frame wall 71*m* may be removed or deformed. In other words, the distance increasing step (the gap increasing step) illustrated in the first embodiment may be performed as well. In such a case, the amount by which the flange wall 63*a* is removed can be reduced.

Note that in the circumferential direction, desirably, a length of a portion of the drive-side flange 63 that has been removed is longer than a length 71*q* of the frame wall 71*m*.

As described above, the new drive-side flange 163 serving as the second edge portion member can be manufactured. Note that in the method described above, the new drive-side flange 163 is manufactured with the drive-side flange 63 by removing the flange wall 63*a*; however, the present disclosure is not limited to the above method. A drive-side flange having a shape that is the same as that of the new drive-side flange 163 described above may be newly manufactured without reusing the drive-side flange 63.

Furthermore, when the flange wall 63*a* is removed or the like in the step of separating the drum 62 from the photosensitive unit 60 illustrated in the first embodiment, the separating step may be deemed as the removing step of the flange wall 63*a* (a step of manufacturing a new drive-side flange 163).

Step of Attaching Drum

Figure 17:
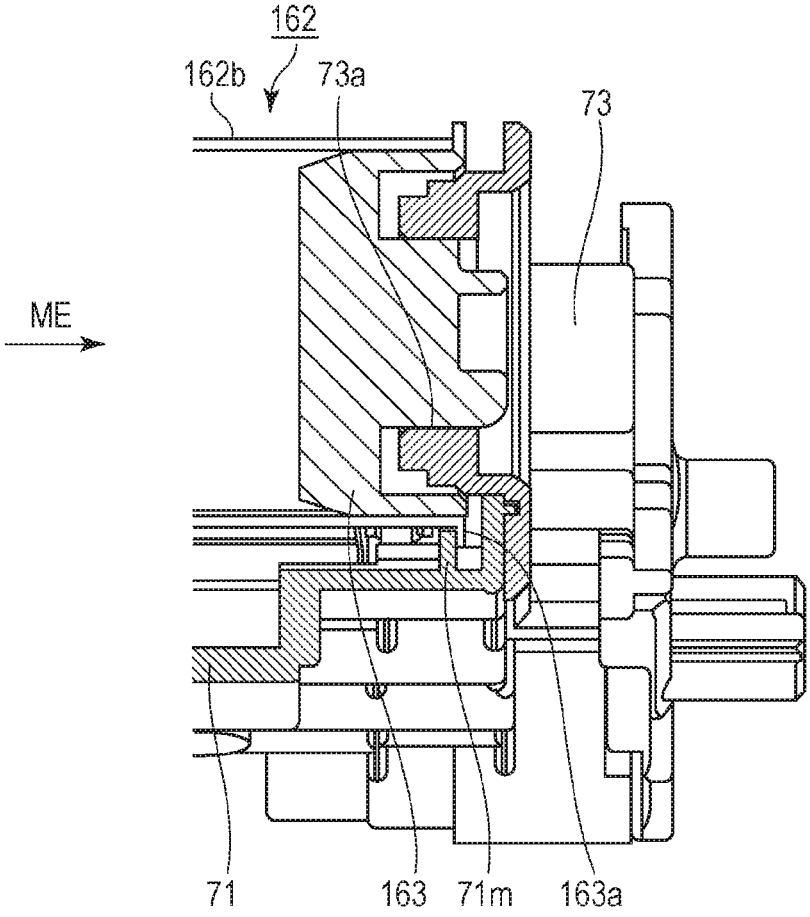
FIG. 17 is a cross-sectional view illustrating a step of attaching a photosensitive drum, according to the second embodiment.

Referring to FIG. 17, an attaching step of attaching a new drum 162 including a new drive-side flange 163 to the drum supporting member 73 through the hole portion 73*a* will be described.

FIG. 17 is a cross-sectional view illustrating the step of attaching the drum 162, according to the present embodiment.

The drum 162 serving as the second image carrying member includes the drive-side flange 163 and the new photosensitive cylinder 162*b*. Note that the new photosensitive cylinder 162*b* is similar to that described in the first embodiment; accordingly, description thereof will be omitted.

FIG. 17 is a diagram illustrating a state in which the drum 162 including the new drive-side flange 163 illustrated in FIG. 15 is installed in the drum supporting member 73.

As illustrated in FIG. 17, the new drum 162 is installed into the drum supporting frame 71 in the arrow ME direction. In the above, in the drum installing direction ME, the amount overlapping the plane of projection of the frame wall 71*m* of the drum supporting frame 71 is smaller. With the above, since the drive-side flange 163 can be readily engaged with the hole portion 73*a* of the drum supporting member 73, the drum 162 can be readily installed in the drum supporting frame 71.

Note that in addition to the above step, similar to the first embodiment, the spacer 72 may be attached to the wall surface 71*n* on the nondrive side of the drum supporting frame 71.

Furthermore, since the method of manufacturing the new cartridge by disassembling the developing unit 20, refilling of toner, and rejoining the developing unit 20 is the same as the first embodiment, herein, description thereof will be omitted.

As described above, a new cartridge can be manufactured by recycling a cartridge B served as the material for the recycling.

Either one of the methods in the first embodiment and the second embodiment described above may be performed or both may be performed as necessary.

According to the present disclosure, a new cartridge can be manufactured by recycling a cartridge B served as the material for the recycling. More specifically, the photosensitive unit 60 that includes the drum 62 including the drive-side flange 63 having a flange wall 63*a*, the drum supporting frame 71 to which the drum supporting member 73 supporting the drum 62 is adhered, and the frame wall 71*m* that restricts the flange wall 63*a* can be recycled. The frame unit that supports the new drum 162 can be manufactured with the photosensitive unit 60 described above. Furthermore, the new photosensitive unit supporting the new drum 162 can be manufactured with the photosensitive unit 60 described above.

Furthermore, according to the method of the present embodiment, separation of the drum 62 and joining of the new drum 162 can be facilitated.

According to the present disclosure, a method of recycling a first unit that includes an image carrying member including an edge portion member having a restricted portion, a frame to which a supporting member supporting the image carrying member is adhered, and a restricting portion restricting the restricted portion can be provided. More specifically, a method of manufacturing a frame unit, which supports the image carrying member, by disassembling the first unit can be provided. Furthermore, a frame unit manufactured with the method described above, and a cartridge including the frame unit can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-068252 filed Mar. 30, 2018 and No. 2019-022803, filed Feb. 12, 2019, which are hereby incorporated by reference herein in their entirety.

What is claimed is:

1. A method of manufacturing a frame unit from a first unit, in which the first unit comprises, a first image carrying member that is configured to carry an electrostatic latent image, wherein the first image carrying member includes a first edge portion member, and the first edge portion member includes a first restricted portion, a supporting member that supports the first image carrying member, wherein the supporting member includes a bearing that is configured to engage with the first edge portion member so that the first image carrying member is rotatable about a rotational axis, and a frame to which the supporting member is adhered, the frame including a first end portion to which the supporting member is fixed, a second end portion opposite to the first end portion in a direction of the rotational axis, a first restricting portion that is configured to restrict movement of the first image carrying member, wherein in a direction orthogonal to the rotational axis, the first restricting portion protrudes towards the first image carrying member, and the first restricting portion is configured to abut against the first restricted portion if the first restricted portion is moved towards the second end portion from the first end portion in the direction of the rotational axis, wherein with respect to the direction of the rotational axis, a position of the first restricting portion and a position of the bearing overlap each other at least partially, and wherein when viewed in the direction of the rotational axis, the first restricting portion is arranged to overlap a first circle drawn by the first restricted portion if the first image carrying member is rotated about the rotational axis, the method of manufacturing the frame unit from the first unit comprising:

a separating step in which the first image carrying member is separated from the supporting member while the supporting member is adhered to the frame.

2. The method of manufacturing a frame unit according to claim 1, further comprising:

a height reducing step in which a height of the first restricting portion is reduced in the direction orthogonal to the rotational axis.

3. The method of manufacturing a frame unit according to claim 2, wherein the height reducing step includes removal of at least a portion of the first restricting portion.

4. The method of manufacturing a frame unit according to claim 3, wherein the portion of the first restricting portion is removed such that the first restricting portion is located outside the first circle when viewed in the direction of the rotational axis.

5. The method of manufacturing a frame unit according to claim 2, wherein the height reducing step includes deforming the first restricting portion.

6. The method of manufacturing a frame unit according to claim 5, wherein the first restricting portion is deformed so that the first restricting portion is located outside the first circle when viewed in the direction of the rotational axis.

7. A method of manufacturing an image carrying unit comprising:

an attaching step in which the first image carrying member or a second image carrying member that is configured to carry an electrostatic latent image is attached to the frame unit manufactured with the method of manufacturing according to claim 2, wherein the first image carrying member or the second image carrying member is supported by the supporting member.

8. The method of manufacturing an image carrying unit according to claim 7, further comprising:

a step of forming a second restricting portion, wherein the second restricting portion is configured to restrict movement of the first image carrying member or the second image carrying member if the first image carrying member or the second image carrying member is moved towards the second end portion from the first end portion.

9. A method of manufacturing a cartridge attachable to an image forming apparatus, the method of manufacturing a cartridge comprising:

a joining step in which a developing unit that contains developer is joined to an image carrying unit that is manufactured with the method of manufacturing according to claim 7.

10. A method of manufacturing an image carrying unit comprising:

an attaching step in which the first image carrying member or a second image carrying member that is configured to carry an electrostatic latent image is attached to the frame unit manufactured with the method of manufacturing according to claim 1, wherein the first image carrying member or the second image carrying member is supported by the supporting member.

11. The method of manufacturing an image carrying unit according to claim 10, further comprising:

a step of forming a second restricting portion, wherein the second restricting portion is configured to restrict movement of the first image carrying member or the second image carrying member if the first image carrying member or the second image carrying member is moved towards the second end portion from the first end portion in the direction of the rotational axis.

12. A method of manufacturing a cartridge attachable to an image forming apparatus, the method of manufacturing a cartridge comprising:

a joining step in which a developing unit that contains developer is joined to an image carrying unit that is manufactured with the method of manufacturing according to claim 10.

13. A method of manufacturing an image carrying unit, comprising:

an attaching step in which a second image carrying member configured to carry an electrostatic latent image is attached to the frame unit manufactured with the method of manufacturing according to claim 1, wherein the second image carrying member is supported by the supporting member, and the second image carrying member includes a second edge portion member, wherein a second circle drawn by the second edge portion member if the second image carrying member is rotated about the rotational axis is smaller than the first circle.

14. The method of manufacturing an image carrying unit according to claim 13, wherein the first restricting portion is located outside the second circle when viewed in a direction of the rotational axis.

15. The method of manufacturing an image carrying unit according to claim 13, further comprising:

a step of manufacturing the second edge portion member from the first edge portion member by removing at least a portion of the first restricted portion.

16. The method of manufacturing an image carrying unit according to claim 13, further comprising:

a step of forming a second restricting portion, wherein the second restricting portion is configured to restrict movement of the first image carrying member or the second image carrying member if the second image carrying member is moved towards the second end portion from the first end portion.

17. A method of manufacturing a cartridge attachable to an image forming apparatus, the method of manufacturing a cartridge comprising:

a joining step in which a developing unit that contains developer is joined to an image carrying unit that is manufactured with the method of manufacturing according to claim 13.

18. A method of manufacturing an image carrying unit, comprising:

an attaching step in which a second image carrying member configured to carry an electrostatic latent image is attached to the frame unit manufactured with the method of manufacturing according to claim 1, wherein the second image carrying member is supported by the supporting member, the second image carrying member includes a second edge portion member, the second edge portion member includes a second restricted portion which includes a recessed portion recessed towards a rotational axis, wherein when viewed in a direction of the rotational axis, a second circle drawn by the second restricted portion if the second image carrying member is rotated about the rotational axis and the first restricting portion overlap each other, and wherein a third circle drawn by the recessed portion if the second image carrying member is rotated about the rotational axis is located inside the first circle.

19. The method of manufacturing an image carrying unit according to claim 18, wherein in a rotation direction of the second image carrying member, a length of the recessed portion is longer than a length of the first restricting portion.

20. The method of manufacturing an image carrying unit according to claim 18, wherein the first restricting portion is located outside the third circle when viewed in the direction of the rotational axis.

21. The method of manufacturing an image carrying unit according to claim 18, further comprising:

a step of manufacturing the second edge portion member from the first edge portion member by removing at least a portion of the first restricted portion.

22. The method of manufacturing an image carrying unit according to claim 18, further comprising:

a step of forming a second restricting portion, wherein the second restricting portion is configured to restrict movement of the first image carrying member or the second image carrying member if the second image carrying member is moved towards the second end portion from the first end portion.

23. A method of manufacturing a cartridge attachable to an image forming apparatus, the method of manufacturing a cartridge comprising:

a joining step in which a developing unit that contains developer is joined to an image carrying unit that is manufactured with the method of manufacturing according to claim 18.

24. A cartridge attachable to an image forming apparatus, the cartridge comprising:

an image carrying member that is configured to carry an electrostatic latent image, wherein the image carrying member includes an edge portion member, and the edge portion member includes a restricted portion;

a supporting member that supports the image carrying member, wherein the supporting member includes a bearing that is configured to engage with the edge portion member so that the image carrying member is rotatable about a rotational axis;

a frame to which the supporting member is fixed, the frame including a first end portion to which the supporting member is fixed, a second end portion opposite to the first end portion in a direction of the rotational axis, a restricting portion that is configured to restrict movement of the image carrying member, wherein in a direction orthogonal to the rotational axis, the restricting portion protrudes towards the image carrying member, and wherein the restricting portion is configured to abut against the restricted portion if the restricted portion is moved towards the second end portion from the first end portion in the direction of the rotational axis; and a developing unit configured to hold a developer carrying member for supply of developer to the image carrying member, wherein a recessed portion recessed towards the rotational axis is formed in the restricted portion, and wherein when viewed in the direction of the rotational axis, the restricting portion overlaps a first circle drawn by the restricted portion if the image carrying member is rotated about the rotational axis, and a circle drawn by the recessed portion if the image carrying member is rotated about the rotational axis is located inside the first circle.

25. The cartridge according to claim 24, wherein in a rotation direction of the image carrying member, a length of the recessed portion is longer than a length of the restricting portion.

26. The cartridge according to claim 24, wherein when viewed in the direction of the rotational axis, the restricting portion is located outside a circle drawn by the recessed portion when the image carrying member rotates.

* * * * *